US010178717B2

(12) United States Patent
Seyler et al.

(10) Patent No.: US 10,178,717 B2
(45) Date of Patent: Jan. 8, 2019

(54) LAMP-CONTROL CIRCUIT FOR LAMP ARRAY EMITTING CONSTANT LIGHT OUTPUT

(71) Applicants: Sean Paul Seyler, Surrey (CA); Dongming Li, Surrey (CA); Wen Wen Li, Surrey (CA)

(72) Inventors: Sean Paul Seyler, Surrey (CA); Dongming Li, Surrey (CA); Wen Wen Li, Surrey (CA)

(73) Assignees: Dongming Li, Surrey, BC (CA); Sean Seyler, Surrey, BC (CA)

( * ) Notice: Subject to any disclaimer, the term of this patent is extended or adjusted under 35 U.S.C. 154(b) by 9 days.

(21) Appl. No.: 15/454,262

(22) Filed: Mar. 9, 2017

(65) Prior Publication Data

US 2018/0263089 A1 Sep. 13, 2018

(51) Int. Cl.
*H05B 33/08* (2006.01)

(52) U.S. Cl.
CPC ..... *H05B 33/0815* (2013.01); *H05B 33/083* (2013.01); *H05B 33/089* (2013.01); *H05B 33/0845* (2013.01)

(58) Field of Classification Search
CPC ..... H05B 33/0809; H05B 33/0815; H05B 33/0845; H05B 33/083; H05B 33/0851; H05B 37/02; H05B 33/0803; H05B 33/0821; H05B 33/0824; H05B 33/0812; H05B 33/0842; H05B 33/0884; H05B 33/0827; H05B 33/0848; H05B 33/0806; H05B 33/089; H05B 37/0272; H05B 33/0854; H05B 33/086; H05B 33/0887; H05B 33/0893; H05B 37/0209; H05B 37/0281; H05B 41/39; H05B 33/0818
See application file for complete search history.

(56) References Cited

U.S. PATENT DOCUMENTS

| | | | |
|---|---|---|---|
| 7,906,917 | B2 | 3/2011 | Traipathi et al. |
| 8,456,095 | B2 | 6/2013 | Huynh |
| 8,492,986 | B2 | 7/2013 | Radermacher |
| 8,901,841 | B2 | 12/2014 | Choi et al. |
| 9,084,323 | B2 | 7/2015 | Yang |

(Continued)

FOREIGN PATENT DOCUMENTS

| | | |
|---|---|---|
| WO | 2012096528 | 7/2012 |
| WO | 201214648 | 10/2012 |

(Continued)

*Primary Examiner* — Tung X Le
*Assistant Examiner* — Borna Alaeddini

(57) ABSTRACT

An apparatus includes a lamp-control circuit. The lamp-control circuit is configured to be electrically connectable to an electrical source having an output voltage that forms a periodic wave formation. The lamp-control circuit is also configured to be electrically connectable to a lamp array. This is done in such a way that electrical current, in use, flows from the electrical source to, and through, the lamp array. The lamp array includes lamp segments. The lamp-control circuit is also configured to urge each lamp segment of the lamp array to consume relatively constant power for a portion of a cycle of the output voltage of the electrical source in such a way that said each lamp segment of the lamp array, in use, emits a relatively constant light output for the portion the cycle of the output voltage of the electrical source.

20 Claims, 29 Drawing Sheets

(56) References Cited

U.S. PATENT DOCUMENTS

| | | | | |
|---|---|---|---|---|
| 9,246,403 | B2 | 1/2016 | Siessegger et al. | |
| 9,357,605 | B2 * | 5/2016 | Jung | H05B 33/0824 |
| 9,380,657 | B2 | 6/2016 | Akiyama et al. | |
| 9,451,662 | B1 | 9/2016 | Chung et al. | |
| 9,451,663 | B2 * | 9/2016 | Jang | H05B 33/083 |
| 9,585,214 | B2 * | 2/2017 | Jung | H05B 33/0824 |
| 9,992,827 | B2 * | 6/2018 | Moussakov | H05B 33/0824 |
| 2008/0252229 | A1 | 10/2008 | Wu | |
| 2012/0081022 | A1 * | 4/2012 | Moussakov | H05B 33/0824 315/240 |
| 2013/0162149 | A1 | 6/2013 | Van De Ven et al. | |
| 2013/0187555 | A1 | 7/2013 | Pan et al. | |
| 2013/0249426 | A1 * | 9/2013 | Tao | H05B 33/0809 315/201 |
| 2013/0313984 | A1 * | 11/2013 | Maiwald | H05B 33/0824 315/188 |
| 2014/0125239 | A1 | 5/2014 | Sullivan et al. | |
| 2014/0125240 | A1 | 5/2014 | Bordin et al. | |
| 2014/0346954 | A1 | 11/2014 | Li et al. | |
| 2015/0097484 | A1 * | 4/2015 | Lee | H05B 33/0848 315/85 |
| 2015/0181663 | A1 | 6/2015 | Gray et al. | |
| 2015/0305098 | A1 * | 10/2015 | Jung | H05B 33/0824 315/122 |
| 2015/0351181 | A1 | 12/2015 | Huang et al. | |
| 2016/0088704 | A1 | 3/2016 | Lenk et al. | |
| 2016/0128153 | A1 * | 5/2016 | Jung | H05B 33/0851 315/201 |
| 2016/0309556 | A1 | 10/2016 | Gong et al. | |

FOREIGN PATENT DOCUMENTS

| | | |
|---|---|---|
| WO | 2013074913 | 5/2013 |
| WO | 2014117607 | 8/2014 |
| WO | 2015149013 | 10/2015 |
| WO | 2016012522 | 1/2016 |
| WO | 2016049054 | 3/2016 |

* cited by examiner

| Switch | LED voltage | | | |
|---|---|---|---|---|
| | U (LED_1) | U (LED_2) | U (LED_3) | U (LED_4) |
| 132 | ON | OFF | OFF | OFF |
| 142 | H | ON | OFF | OFF |
| 152 | H | H | ON | OFF |
| 162 | H | H | H | ON |

H = high-impedance state

FIG. 3B

NON-DIMMING (NO DIMMING)

NON-DIMMING

NON-DIMMING

NON-DIMMING

NON-DIMMING

NON-DIMMING

NON-DIMMING

DIMMING DOWN TO 80 PERCENT

DIMMING DOWN TO 80 PERCENT

AFTER RECTIFIER CURRENT

DIMMING DOWN TO 80 PERCENT

DIMMING DOWN TO 80 PERCENT

DIMMING DOWN TO 80 PERCENT

DIMMING DOWN TO 80 PERCENT

DIMMING DOWN TO 80 PERCENT

DIMMING DOWN TO 20 PERCENT

DIMMING DOWN TO 20 PERCENT

DIMMING DOWN TO 20 PERCENT

DIMMING DOWN TO 20 PERCENT

DIMMING DOWN TO 20 PERCENT

DIMMING DOWN TO 20 PERCENT

DIMMING DOWN TO 20 PERCENT

LAMP-CONTROL CIRCUIT FOR LAMP ARRAY EMITTING CONSTANT LIGHT OUTPUT

TECHNICAL FIELD

This document relates to the technical field of (and is not limited to) lamp control.

BACKGROUND

Lamp devices are known to emit light (photons or light output) that may vary (for one reason or other).

SUMMARY

It will be appreciated that there exists a need to mitigate (at least in part) at least one problem associated with the existing lamp control systems and lamp control methods (also called the existing technology). After much study of the known systems and methods with experimentation, an understanding of the problem and its solution has been identified and is articulated as follows:

It is not a desirable condition for users to have lamp devices that emit light that may vary. For instance, lamp devices (light sources, lamps, LEDs), etc. sometimes flicker. Light flicker refers to quick, repeated changes in light intensity - light that appears to flutter and be unsteady. Light flicker maybe caused when the voltage supplied to the lamp device changes or when the power line voltage itself fluctuates. The severity of the light flicker depends on several factors such as: (A) how often and regularly the voltage fluctuates; (B) how much of a voltage change occurs; (C) the kind or type of light or lamp, such as an LED (Light-Emitting Diode), OLED (Organic Light-Emitting Diode), LD (Laser Diode), etc.); (D) the gain factor of the lamp device (the gain factor is a measure of how much the light intensity changes when the voltage fluctuates, such as {the percentage relative change in light levels} divided by {the percentage relative fluctuation in voltage}); and/or (E) the amount of light in the lighted area (ambient light levels).

The lamp device operating on AC (Alternating Current) electric systems produce light flickering at a frequency of Hertz (Hz, cycles per second), twice the power line frequency of sixty (60) Hz (50 Hz in many countries outside North America). For 60 Hz power systems, essentially, the power is turning ON and OFF times a second. Actually, the voltage varies from (+) volts to (−) volts AC (Alternating Current), 60 times or cycles a second and is at zero volts twice in a cycle.

To mitigate, at least in part, at least one problem associated with the existing technology, there is provided (in accordance with a first major aspect) an apparatus. In accordance with a first major aspect, the apparatus includes and is not limited to (comprises) a lamp-control circuit. The lamp-control circuit is configured to be electrically connectable to an electrical source. The electrical source has an output voltage that forms a periodic wave formation. Preferably, the output voltage forms a sine wave formation (and any equivalent thereof).The lamp-control circuit is also configured to be electrically connectable to a lamp array. This is done in such a way that electrical current, in use, flows from the electrical source to, and through, the lamp array. The lamp array includes (preferably, is divided into) lamp segments. The lamp-control circuit also configured to urge each lamp segment of the lamp array to consume relatively constant power for a portion of (preferably, for a duration of) a cycle of the output voltage of the electrical source. This is done in such a way that said each lamp segment of the lamp array, in use, emits a relatively constant light output for the portion (preferably, for the duration of) the cycle of the output voltage of the electrical source. Advantageously, the apparatus, in use, reduces (improves), at least in part, the flicker problem associated with the light that is (photons that are) emitted from said each lamp segment of the lamp array.

To mitigate, at least in part, at least one problem associated with the existing technology, there is provided (in accordance with a second major aspect) a method. In accordance with the second major aspect, the method is for operation of an electrical source and a lamp array. The electrical source has an output voltage that forms a wave formation. The lamp array includes (preferably, is divided into) lamp segments. The method includes and is not limited to (comprises) urging electrical current to flow from the electrical source to, and through, the lamp array. The method also includes urging each lamp segment of the lamp array to consume relatively constant power for a portion of (preferably, for a duration of) a cycle of the output voltage of the electrical source. This is done in such a way that each lamp segment of the lamp array, in use, emits a relatively constant light output for the portion (preferably, for the duration of) the cycle of the output voltage of the electrical source.

To mitigate, at least in part, at least one problem associated with the existing technology, there is provided (in accordance with a third major aspect) an apparatus. In accordance with the third major aspect, the apparatus includes and is not limited to (comprises) a lamp-control circuit. The lamp-control circuit is configured to be electrically connectable to an electrical source. The electrical source has an output voltage that forms a periodic wave formation. Preferably, the output voltage forms a sine wave formation, and any equivalent thereof The lamp-control circuit is also configured to be electrically connectable to an LED array. This is done in such a way that electrical current, in use, flows from the electrical source to, and through, the LED array. The LED array includes (preferably, is divided into) LED segments. The lamp-control circuit is also configured to urge each LED segment of the LED array to consume relatively constant power for a portion of (preferably, for a duration of) a cycle of the output voltage of the electrical source. This is done in such a way that said each LED segment of the LED array, in use, emits a relatively constant light output for the portion (preferably, for the duration of) the cycle of the output voltage of the electrical source. Advantageously, the apparatus, in use, reduces (improves), at least in part, the flicker problem associated with the light that to be emitted by said each LED segment of the LED array.

To mitigate, at least in part, at least one problem associated with the existing technology, there is provided (in accordance with a fourth major aspect) a method. In accordance with the fourth major aspect, the method is for operating an electrical source and an LED array. The electrical source has an output voltage that forms a wave formation (preferably, the output voltage forms a sine wave formation and any equivalent thereof). The LED array includes (preferably, is divided into) LED segments. The method includes and is not limited to (comprises) urging electrical current to flow from the electrical source to, and through, the LED array. The method also includes urging each LED segment of the LED array to consume relatively constant power for a portion of (preferably, for a duration of) a cycle of the output voltage of the electrical source. This is done in such a way that said each LED segment of the LED array, in use, emits a relatively constant light output for the portion (preferably, for the duration of) the cycle of the output voltage of the electrical source.

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which:

FIG. 3B depicts the states of controllable switches for utilization with the segment detection unit of FIG. 3A;

Figure 1A:
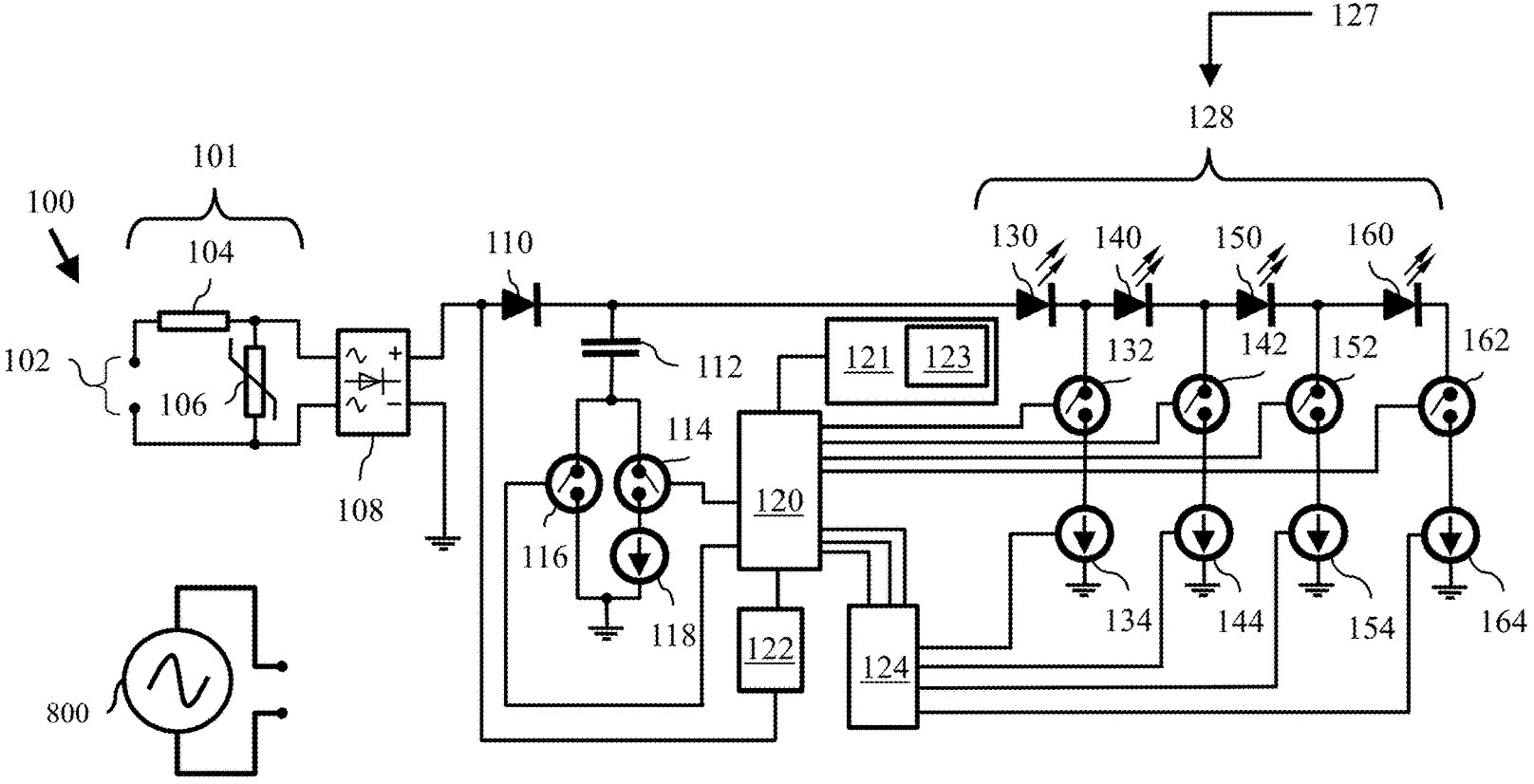
FIG. 1A depicts a schematic view of an embodiment of a lamp-control circuit.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 lamp-control circuit
101 protection circuit
102 power terminals
104 fuse component
106 surge-protector component
108 rectifier bridge
110 first isolating diode
112 energy-storage device (such as a capacitor, etc.)
114 first main controllable switch
116 second main controllable switch
118 main current source
120 control logic unit
121 memory assembly
122 dimmer detection unit
123 executable program
124 segment detection unit
127 lamp array
128 LED array, or light-emitting diode array
130 LED segment, or light-emitting diode segment
132 controllable switch
134 controllable current source
140 LED segment, or light-emitting diode segment
142 controllable switch
144 controllable current source
150 LED segment, or light-emitting diode segment
152 controllable switch
154 controllable current source
160 LED segment, or light-emitting diode segment
162 controllable switch
164 controllable current source
170 first current path
180 second current path
202 first operation
204 second operation
206 third operation
208 fourth operation
210 fifth operation
212 sixth operation
214 seventh operation
302 comparator
304 reference voltage terminal
306 second capacitor
308 second isolating diode
310 first resistor
312 second resistor
314 first operational amplifier
316 second operational amplifier
318 third operational amplifier
320 third resistor
322 fourth resistor
324 fifth resistor
326 first resistor divider circuit
328 second resistor divider circuit

330 third resistor divider circuit
800 electrical source
900 dimmer module

DETAILED DESCRIPTION OF THE EXEMPLARY EMBODIMENTS

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that, for instance, the scope of the meaning of a device configured to be coupled (connected, interact with, etc.) to an item is to be interpreted as the device is configured to be coupled (connected, interact with, etc.), either directly or indirectly, to the item. Therefore, "configured to" may include the meaning "either directly or indirectly" unless specifically stated otherwise.

FIG. 1A depicts a schematic view of an embodiment of a lamp-control circuit 100.

In accordance with a first major embodiment, an apparatus is provided. The apparatus includes and is not limited to (comprises) a lamp-control circuit 100. The lamp-control circuit 100 is configured to be electrically connectable to an electrical source 800. The electrical source 800 has an output voltage that forms a periodic wave formation. Preferably, the output voltage forms a sine wave formation (and any equivalent thereof). The lamp-control circuit 100 is also configured to be electrically connectable to a lamp array 127. This is done in such a way that electrical current, in use, flows from the electrical source 800 to, and through, the lamp array 127. The lamp array 127 includes (preferably, is divided into) lamp segments. A lamp segment may include at least one lamp or at least one or more lamps, etc. The lamp-control circuit 100 also configured to urge each lamp segment of the lamp array 127 to consume relatively constant power for a portion of (preferably, for a duration of) a cycle of the output voltage of the electrical source 800. This is done in such a way that each lamp segment of the lamp array 127, in use, emits a relatively constant light output for the portion (preferably, for the duration of) the cycle of the output voltage of the electrical source 800. Advantageously, the apparatus, in use, reduces (improves), at least in part, the flicker problem associated with each lamp segment of the lamp array 127.

In accordance with a second major embodiment, a method is provided. The method is for operation of an electrical source 800 and a lamp array 127. The electrical source 800 has an output voltage that forms a periodic wave formation. The lamp array 127 includes (preferably, is divided into) lamp segments. The method includes and is not limited to (comprises) urging electrical current to flow from the electrical source 800 to, and through, the lamp array 127. The method also includes urging each lamp segment of the lamp array 127 to consume relatively constant power for a portion of (preferably, for a duration of) a cycle of the output voltage of the electrical source 800. This is done in such a way that each lamp segment of the lamp array 127, in use, emits a relatively constant light output for the portion (preferably, for the duration of) the cycle of the output voltage of the electrical source 800.

In accordance with a third major embodiment, an apparatus includes and is not limited to (comprises) a lamp-control circuit 100. The lamp-control circuit 100 is configured to be electrically connectable to an electrical source 800. The electrical source 800 has an output voltage that forms a periodic wave formation. Preferably, the output voltage forms a sine wave formation, and any equivalent thereof. The lamp-control circuit 100 is also configured to be electrically connectable to an LED array 128. This is done in such a way that electrical current, in use, flows from the electrical source 800 to, and through, the LED array 128. The LED array 128 includes (preferably, is divided into) a set of the LED segments (130, 140, 150, 160) or light-emitting diode segments (130, 140, 150, 160). The lamp-control circuit 100 is also configured to urge each LED segment (130, 140, 150, 160) of the LED array 128 to consume relatively constant power for a portion of (preferably, for a duration of) a cycle of the output voltage of the electrical source 800. This is done in such a way that each LED segment (130, 140, 150, 160) of the LED array 128, in use, emits a relatively constant light output for the portion (preferably, for the duration of) the cycle of the output voltage of the electrical source 800. Advantageously, the apparatus, in use, reduces (improves), at least in part, the flicker problem associated with said each LED segment (130, 140, 150, 160) of the LED array 128.

In accordance with a fourth major embodiment, a method is provided. The method is for operating an electrical source 800 and an LED array 128. The electrical source 800 has an output voltage that forms a periodic wave formation (preferably, the output voltage forms a sine wave formation and any equivalent thereof). The LED array 128 includes (preferably, is divided into) LED segments (130, 140, 150, 160). The method includes and is not limited to (comprises) urging electrical current to flow from the electrical source 800 to, and through, the LED array 128. The method also includes urging each LED segment (130, 140, 150, 160) of the LED array 128 to consume relatively constant power for a portion of (preferably, for a duration of) a cycle of the output voltage of the electrical source 800. This is done in such a way that each LED segment (130, 140, 150, 160) of the LED array 128, in use, emits a relatively constant light output for the portion (preferably, for the duration of) the cycle of the output voltage of the electrical source 800.

In accordance with a preferred embodiment, the lamp-control circuit 100 is also configured to urge each LED segment (130, 140, 150, 160) of the LED array 128 to (A) consume relatively constant power for a duration of a cycle of the output voltage of the electrical source 800, and (B) emit a relatively constant light output for the duration of the cycle of the output voltage of the electrical source 800.

In accordance with a preferred embodiment, the lamp-control circuit 100 is also configured control the electrical current flowing through the LED array 128 according to an aspect of the periodic wave formation of the output voltage of the electrical source 800.

In accordance with a preferred embodiment, the lamp-control circuit 100 includes (and is not limited to) an energy-storage device 112.

The energy-storage device 112 is configured to selectively store and selectively discharge electrical energy (or supply electrical energy). In accordance with a preferred embodiment, the energy-storage device 112 includes a capacitor, and any equivalent thereof. For instance, the energy-storage device 112 may include a capacitor (capacitors), an inductor (inductors), a combination of a capacitor (capacitors) and/or inductor (inductors), etc., in any combination any permutation thereof. The energy-storage device 112 is configured to be electrically connectable to the LED array 128. The lamp-control circuit 100 also includes a control logic unit 120 configured to be electrically connectable to the energy-storage device 112. The control logic unit 120 is also configured to selectively urge charging and selectively urge discharging of the energy-storage device 112. A technical effect of the energy-storage device 112 is that, for the case where the interval of the cycle of the output voltage of the electrical source 800 is relatively short (compared with the whole cycle of the output voltage of the electrical source 800), the stored energy required allows utilization of a relatively smaller amount of (volume of) the energy-storage device 112 for charging and discharging utilization purposes in comparison to known systems for the control of lamps.

In accordance with a preferred embodiment, the control logic unit 120 is also configured to urge charging of the energy-storage device 112 with electrical energy provided by the electrical source 800 once the control logic unit 120, in use, determines that the output voltage of the electrical source 800 is higher than a first predetermined value (such as, the forward threshold voltage or the turn-on voltage) associated with a fourth LED segment 160 (also called a selected LED segment 160) of the LED array 128.

In accordance with a preferred embodiment, the control logic unit 120 is also configured to urge discharging of the electrical energy from the energy-storage device 112 to the first LED segment 130 of the LED array 128 once the control logic unit 120, in use, determines that the output voltage of the electrical source 800 is lower than a second predetermined value (such as, the forward sub-threshold voltage) associated with a first LED segment 130 (also called a selected LED segment 130) of the LED array 128.

In accordance with a preferred embodiment, the control logic unit 120 is also configured to urge the current flowing through a first LED segment 130 of the LED array 128 to have a maximum value for a case where the output voltage of the electrical source 800 has a minimum value.

In accordance with a preferred embodiment, the control logic unit 120 is also configured to urge the current flowing through a second LED segment 140 (also called a selected LED segment 140) of the LED array 128 to have a reduced value for a case where the output voltage of the electrical source 800 has an increased value.

In accordance with a preferred embodiment, the energy-storage device 112 is configured to supply electrical power to the LED array 128 for a case where the output voltage of the electrical source 800 is lower than a second predetermined value (such as, the forward sub-threshold voltage) associated with the first LED segment 130. The first LED segment 130 is also called a selected LED segment 130 of the LED array 128. This is done in such a way that the energy-storage device 112, in use, urges the LED array 128 to consume a relatively constant power so that the lamp array 128, in use, emits a relatively constant light output.

In accordance with a preferred embodiment, a dimmer module 900 (depicted in FIG. 1B) is electrically connected to the lamp-control circuit 100. The lamp-control circuit 100 is configured to urge the LED array 128 to consume a relatively constant power in such a way that the LED array 128, in use, emits a relatively constant light output.

Referring to the embodiment as depicted in FIG. 1A, the lamp-control circuit 100 is configured to control (provide) electrical power to a lamp array 127. This is done in such a way that the lamp array 127, in use, emits light (photons) having a relatively lower rate of flicker (or relatively lower percent rate of flicker). The lamp array 127 may include various types of lamps (lamp devices, such as LED (Light-Emitting Diode), OLED (Organic Light-Emitting Diode), the LD (Laser Diode), etc., and any equivalent thereof More preferably, the lamp-control circuit 100 is configured for utilization with LED lamps (LED or Light-Emitting Diode) of the LED array 128, and any equivalent thereof. Equivalents of the LED lamps may include OLED (Organic Light-Emitting Diode), the LD (Laser Diode), etc. Lamps that are not equivalent to the LED lamps may include the incandescent lamp, the fluorescent lamp, and/or the HID (High-Intensity Discharge Lamps) lamp.

In accordance with an embodiment, the lamp array 127 includes (for instance) an LED array 128. LED stands for Light-Emitting Diode. The LED array 128 includes LED segments. An LED segment may include at least one LED or more than one LEDs (which may be connected together in nay desired arrangement). For instance, the LED array 128 may include a series connection of a first LED segment 130, a second LED segment 140, a third LED segment 150, and a fourth LED segment 160, etc. (as depicted in the embodiment of FIG. 1A). It will be appreciated that the LED array 128 may be series connected, parallel connected, or series and parallel connected, etc.

For instance, for the case where it is desired to dim (reduce) the light output of the LED array 128 from 100 percent (light output) down to 20 percent (light output), the lamp-control circuit 100 is configured to maintain the flicker rate of the LED array 128 at a relatively lower percentage light-output flicker rate (relatively lower percent flicker rate). Preferably, the lamp-control circuit 100 may be called a linear mode LED driven circuit.

Preferably, the lamp-control circuit 100 includes (and is not limited to) an energy-storage device 112. More preferably, the energy-storage device 112 has a relatively smaller capacitance rating (value). Preferably, the energy-storage device 112 includes an electrolytic capacitor having a value (rating) of about 22 micro Farads (uF).

Figure 1B:
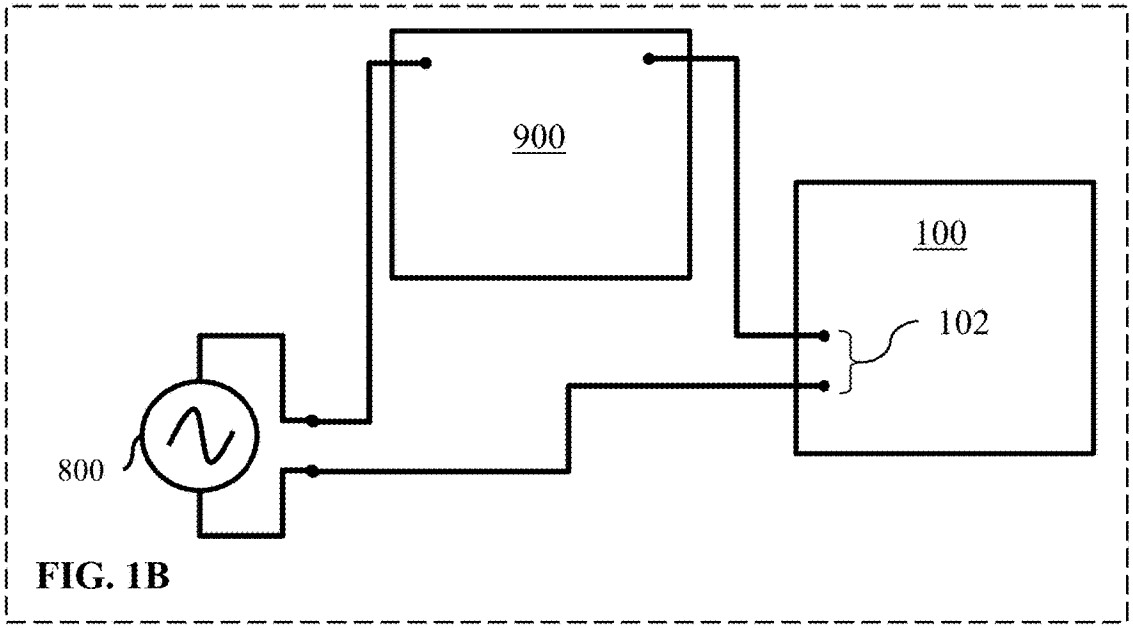
FIG. 1B depicts a schematic view of an embodiment of a dimmer module for utilization with the lamp-control circuit of FIG. 1A.

FIG. 1B depicts a schematic view of an embodiment of a dimmer module 900 for utilization with the lamp-control circuit 100 of FIG. 1A.

In accordance with an embodiment as depicted in FIG. 1B, the lamp-control circuit 100 may be utilized with a dimmer module 900. The dimmer module 900 may include (A) a TRIAC (Triode Alternating Current semiconductor switch) dimmer module and any equivalent thereof, and (B) an ELV (Electronic Low-Voltage) dimmer module and any equivalent thereof. A TRIAC is a three-electrode semiconductor device configured to conduct in either direction when triggered by a positive or negative signal at the gate electrode. The lamp-control circuit 100 is configured to comply (at least in part) with any type of the dimmer module 900. Preferably, the dimmer module 900 includes the LUTRON (TRADEMARK) Model Number DVCL-153PR-WH-C dimmer assembly.

Figure 1C:
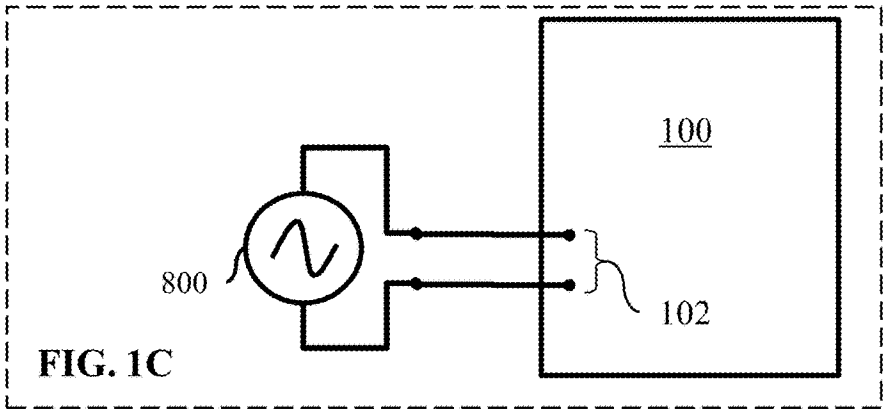
FIG. 1C depicts a schematic view of an embodiment of the lamp-control circuit of FIG. 1A without utilization of the dimmer module of FIG. 1B.

FIG. 1C depicts a schematic view of an embodiment of the lamp-control circuit 100 of FIG. 1A without utilization of the dimmer module 900 of FIG. 1B.

In accordance with an embodiment as depicted in FIG. 1C, the lamp-control circuit 100 is not utilized with (not electrically connectable to) the dimmer module 900 (depicted in FIG. 1B).

Referring to the embodiment as depicted in FIG. 1A, an input current is received from the electrical source 800 (also called a power line, such as 120 Volts Alternating Current or AC) via the power terminals 102. A single branch passes through a protection circuit 101. The protection circuit 101 includes a fuse component 104 and a surge-protector component 106 (such as, a varistor). Then it passes through a rectifier bridge 108. Afterwards, the electrical power is provided to a first circuit branch and a second circuit branch (two circuit branches).

The first circuit branch flows through the LED array 128. Preferably, the LED array 128 includes (preferably, is divided into) several LED segments or at least one or more LED segments (or lamp segments, etc.). The number of the LED segments or lamp segments may depend on the value (magnitude) of the input voltage (such as, 120 Volts AC, etc.). It will be appreciated that (preferably) the input voltage varies in amplitude according to the sine wave or cosine wave pattern (periodic wave formation), and any equivalent thereof.

Referring to the embodiment as depicted in FIG. 1A, the lamp-control circuit 100 is configured to control the magnitude (value) of the current flowing into the LED array 128 according to an aspect of the input voltage (such as, 120 Volts AC). For instance, the aspect of the input voltage includes the amplitude of the input voltage.

For the first segment of the LED array 128, for the case where the input voltage reaches a minimum input-voltage value, the current output reaches a maximum current-output value. For the second segment of the LED array 128, for the case where the input voltage increases in amplitude, the current reduces in amplitude, and so on. For the lamp-control circuit 100, the power dissipation of the LED array 128 is equal to the voltage multiplied by the current. The result is that the lamp-control circuit 100 provides nearly (almost) relatively constant power dissipation for each sine wave (periodic wave) cycle (of the input voltage).

Referring to the embodiment as depicted in FIG. 1A, the lamp-control circuit 100 also includes a second branch. Preferably, the second branch includes an energy-storage device 112 and a control logic unit 120.

Referring to the preferred embodiment as depicted in FIG. 1A, the control logic unit 120 is configured to interface with (or to include) a memory assembly 121. The memory assembly 121 is configured to receive and tangibly store an executable program 123. The executable program 123 includes coded instructions (programmed coded instructions) configured to be readable by, and executable by, the control logic unit 120. The executable program 123 is configured to urge the control logic unit 120 to perform predetermined controller operations, such as the embodiment of the operations depicted in FIG. 6. Equivalents to the executable program 123 include (and are not limited to) machine-language code, assembly-language code, and/or source code formed in a high-level computing language understood by humans. The high-level language of the source code is compiled into either an executable machine code file or a non-executable machine-code object file. Other equivalents to the executable program 123 include: (A) an application-specific integrated circuit (ASIC) and any equivalent thereof, and/or (B) a field-programmable gate array (FPGA) and any equivalent thereof.

For instance, for the case where the amplitude of the input voltage is higher than a first predetermined value (such as, the forward threshold voltage or the turn-on voltage) associated with a fourth LED segment 160 (also called a selected LED segment 160) of the LED array 128, the lamp-control circuit 100 is configured to charge energy to the energy-storage device 112. For the case where the amplitude of the input line voltage is lower than a second predetermined value (such as, the forward sub-threshold voltage) associated with a first LED segment 130 (also called a selected LED segment 130) of the LED array 128, the energy-storage device 112 is configured to discharge the energy to the first LED segment 130 of the LED array 128.

The control logic unit 120 is configured to calculate and control the power dissipation of the first segment of the LED array 128 to be the same as the other segments of the LED array 128. Preferably, this is done in such a way that a relatively constant (nearly constant) power dissipation may be achieved during at least a portion of (preferably, the entire cycle of) the input voltage. The lamp-control circuit 100 is configured to control the LED array 128 in such a way that a relatively constant light output is emitted by the LED array 128 for each cycle of the input voltage.

Since the interval is very short (compared with the whole sine cycle), the stored energy required allows the lamp-control circuit 100 to use a relatively very small volume of the energy-storage device 112 compared to the existing light-control systems currently available today.

In accordance with a preferred embodiment, the control logic unit 120 is configured to interact with a dimmer detection unit 122, in which the dimmer detection unit 122 is configured to be electrically connectable to the lamp-control circuit 100. The control logic unit 120 and the dimmer detection unit 122 are configured to make a determination of whether a dimmer module 900 is electrically connected to the lamp-control circuit 100.

In accordance with a preferred embodiment, the control logic unit 120 is configured to interact with a segment detection unit 124. The segment detection unit 124 is configured to be electrically connectable to each of the LED segments (130, 140, 150, 160) of the LED array 128. This is done in such a way that the control logic unit 120, in use, controls the amount of power consumed by each of the LED segments (130, 140, 150, 160) of the LED array 128.

In accordance with a preferred embodiment, there is provided a dimmer detection unit 122 configured to sample the input voltage and input current associated with the power terminals 102. For the case where the dimmer detection unit 122 determines that the dimmer module 900 is present (is electrically connected to the power terminals 102), the control logic unit 120 is configured to let the segment detection unit 124 obtain a working status of each of the LED segments (130, 140, 150, 160) of the LED array 128.

The control logic unit 120 is configured to adjust the charge and discharge of the energy-storage device 112 in order to keep the same relatively constant power dissipation for the LED array 128 for each sine wave (periodic wave) cycle (for the case where the LED array 128 is being dimmed).

In accordance with a preferred embodiment, the lamp-control circuit 100 solves the light flicker problem by using a relatively smaller volume of the energy-storage device 112 even though the LED segments (130, 140, 150, 160) are dimmed down to about 20 percent light output (photon output). For instance, the LED segments (130, 140, 150, 160) may include the first LED segment 130, the second LED segment 140, the third LED segment 150, and the fourth LED segment 160, etc.

In accordance with a preferred embodiment, the lamp-control circuit 100 includes a synergistic combination of power terminals 102, a protection circuit 101, an energy-storage device 112, a first main controllable switch 114, a second main controllable switch 116, a main current source 118, a control logic unit 120 (also called a charge/discharge control logic unit), a dimmer detection unit 122, a segment detection unit 124, an LED array 128, controllable switches (132, 142, 152, 162), and controllable current sources (134, 144, 154, 164).

The power terminals 102 are configured to receive input power (such as 120 Volts AC).

The protection circuit 101 is configured to electrically protect the components of the lamp-control circuit 100. In accordance with an embodiment, the protection circuit 101 includes a fuse component 104, a surge-protector component 106 (such as a varistor). The fuse component 104 is electrically connected to one of the terminals of the power terminals 102. The surge-protector component 106 (such as a varistor) is electrically connected to the fuse component 104 and to one of the terminals of the power terminals 102. The input side of the rectifier bridge 108 is electrically connected across the surge-protector component 106. One output of the rectifier bridge 108 is electrically connected to electrical ground. One output of the rectifier bridge 108 is electrically connected to the isolating diode 110.

The first main controllable switch 114 includes three terminals (one of which is a control-signal terminals). The second main controllable switch 116 includes three terminals (one of which is a control-signal terminal).

The energy-storage device 112 is electrically coupled to the output of the output side of the first isolating diode 110. The energy-storage device 112 is also electrically coupled to a terminal of the first main controllable switch 114 and to a terminal of the second main controllable switch 116.

The first main controllable switch 114 and the second main controllable switch 116 are each configured to be electrically controllable by the control logic unit 120 (via respective control-signal terminal). Another terminal of the first main controllable switch 114 is electrically connected to a terminal of the main current source 118, and another terminal of the main current source 118 is electrically connected to the electrical ground. Another terminal of the second main controllable switch 116 is electrically connected to the electrical ground.

The control logic unit 120 is configured to control the electrical operation of the first main controllable switch 114 and the second main controllable switch 116. The control logic unit 120 is configured to receive a dimmer signal from the dimmer detection unit 122. The dimmer detection unit 122 is electrically coupled to the input side of the isolating diode 110. The control logic unit 120 is configured to receive an array signal from the segment detection unit 124.

In accordance with an embodiment, the LED array 128 includes segments (a first segment, a second segment, etc.). Each segment of the LED array 128 includes at least one LED. For instance, the first segment includes a first LED segment 130, the second segment includes a second LED segment 140, the third segment includes a third LED segment 150, and the fourth segment includes a fourth LED segment 160.

In accordance with an embodiment, the controllable switches (132, 142, 152, 162) are respectively electrically connected to the segments of the LED array 128. The controllable switches (132, 142, 152, 162) are respectively electrically connected to the control logic unit 120. The controllable switches (132, 142, 152, 162) include a first controllable switch 132, a second controllable switch 142, a third controllable switch 152, and a fourth controllable switch 162.

For instance, the first controllable switch 132 is electrically connected to the first segments of the LED array 128. The second controllable switch 142 is electrically connected to the second segments of the LED array 128. The third controllable switch 152 is electrically connected to the third segments of the LED array 128. The fourth controllable switch 162 is electrically connected to the fourth segments of the LED array 128.

The first controllable switch 132 is electrically connected to the output of the first LED segment 130. The second controllable switch 142 is electrically connected to the output of the second LED segment 140. The third controllable switch 152 is electrically connected to the output of the third LED segment 150. The fourth controllable switch 162 is electrically connected to the output of the fourth LED segment 160.

In accordance with an embodiment, the controllable current sources (134, 144, 154, 164) are respectively electrically connected to the control logic unit 120 (via the segment detection unit 124). The controllable current sources (134, 144, 154, 164) are respectively electrically connected to the controllable switches (132, 142, 152, 162), and are respectively electrically connected to electrical ground. The control logic unit 120 is configured to selectively control operation of each of the controllable current sources (134, 144, 154, 164) (via individual selective activation and selective deactivation of a respective (selected) one of controllable switches (132, 142, 152, 162). This is done in such a way that a predetermined amount of current selectively flows through a respective LED segment of the LED array 128 (preferably, this is performed in accordance with a timing (sequencing) during the cycle of the voltage output of the electrical source 800). The timing (sequencing) for when (and under what conditions) the control logic unit 120 selectively activates and selectively deactivates the controllable current sources (134, 144, 154, 164) is determined (done in accordance with respect to) the embodiments associated with FIGS. 7A-7G, FIGS. 8A-8G, and FIGS. 9A-9G. The controllable current sources (134, 144, 154, 164) include (for instance): (A) a first controllable current source 134, (B) a second controllable current source 144, (C) a third controllable current source 154, and (D) a fourth controllable current source 164. The first controllable current source 134 is electrically connected to the first LED segment 130 in order to selectively draw current through the first LED segment 130 once the first controllable switch 132 is activated accordingly or turned ON by the control logic unit 120. The second controllable current source 144 is electrically connected to the second LED segment 140 in order to selectively draw current through the second LED segment 140 once the second controllable switch 142 is activated accordingly or turned ON by the control logic unit 120. The third controllable current source 154 is electrically connected to the third LED segment 150 in order to selectively draw current through the third LED segment 150 once the third controllable switch 152 is activated accordingly or turned ON by the control logic unit 120. The fourth controllable current source 164 is electrically connected to the fourth LED segment 160 in order to selectively draw current through the fourth LED segment 160 once the fourth controllable switch 162 is activated accordingly or turned ON by the control logic unit 120.

The controllable current sources (134, 144, 154, 164) are configured to provide a working status to the segment detection unit 124. The segment detection unit 124 is configured to provide the working status of the controllable current sources (134, 144, 154, 164) to the control logic unit 120. This is done (determined) in accordance with (with respect to) the embodiments associated with FIGS. 7A-7G, FIGS. 8A-8G, and FIGS. 9A-9G.

The first controllable current source 134 is electrically connected to the first controllable switch 132. The output of the first controllable current source 134 is electrically connected to the electrical ground. The second controllable current source 144 is electrically connected to the second controllable switch 142. The output of the second controllable current source 144 is electrically connected to the electrical ground. The third controllable current source 154 is electrically connected to the third controllable switch 152. The output of the third controllable current source 154 is electrically connected to the electrical ground. The fourth controllable current source 164 is electrically connected to the fourth controllable switch 162. The output of the fourth controllable current source 164 is electrically connected to the electrical ground.

Figure 2:
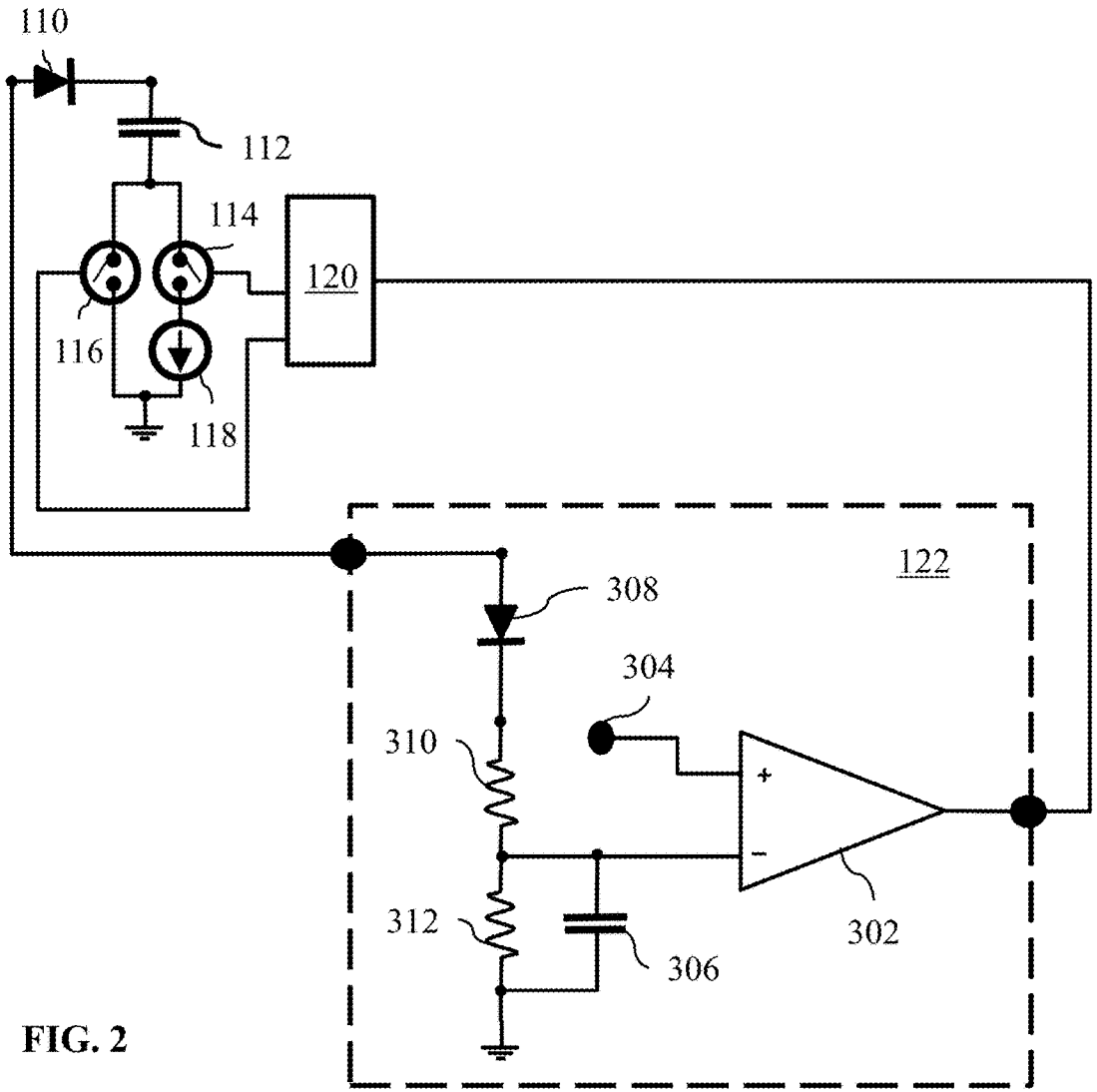
FIG. 2 depicts a schematic view of an embodiment of a dimmer detection unit for utilization with the lamp-control circuit of FIG. 1A.

FIG. 2 depicts a schematic view of an embodiment of a dimmer detection unit 122 for utilization with the lamp-control circuit 100 of FIG. 1A.

Referring to the embodiment as depicted in FIG. 2, the dimmer detection unit 122 includes (and is not limited to) a synergistic combination of a comparator 302. A reference voltage terminal 304, a second capacitor 306, an isolation diode 308, a first resistor 310, and a second resistor 312. Preferably, the second capacitor 306 includes the TDK (TRADENAME) capacitor having a value of about 10 micro Farads rated for about 16 volts. Preferably, the first resistor 310 includes the YAGEO (TRADEMARK) resistor having a value of about 4.7 mega ohms. Preferably, the second resistor 312 includes the YAGEO (TRADEMARK) resistor having a value of about 82 kilo ohms.

The reference voltage is fed to the reference voltage terminal 304, and the reference voltage terminal 304 is electrically connected to the positive input of the comparator 302. The first resistor 310, the second resistor 312 and the second capacitor 306 constitute a voltage dividing network that is fed to the negative input of the comparator 302. The output of the comparator 302 is linked to the control logic unit 120 which will determine whether the dimmer module 900 (the embodiment of which is depicted in FIG. 1B) is electrically connected to the lamp-control circuit 100.

Preferably, for every cycle of the input voltage (as provided across the power terminals 102), the dimmer detection unit 122 is configured to (A) sample the input voltage, and (B) output (provide) a logic level to the control logic unit 120.

For the case where the logic level is 1 (one or high), the control logic unit 120 is configured to determine (compute) that a dimmer module 900 is present (that is, the dimmer module 900 is connected to the LED array 128). For the case where the dimmer module 900 is present (that is, the dimmer module 900 is connected to the LED array 128), the energy-storage device 112 is charged according to the dimmer phase cutting. There are two embodiments provided for describing this case, in which one embodiment is depicted in FIGS. 8A-8G (the 80 percent dimming operation mode), and in which another embodiment is depicted in FIGS. 9A-9G (the 20 percent dimming operation mode).

Referring to the embodiments as depicted in FIG. 2 and FIGS. 7A to 7G, for the case where the logic level is 0 (zero or low), the control logic unit 120 is configured to determine (compute) that the dimmer module 900 is not present (that is, the dimmer module 900 is not connected to the LED array 128). For the case where the dimmer module 900 is not present (that is, the dimmer module 900 is not connected to the LED array 128), the energy-storage device 112 is charged at the maximum value of the input voltage (preferably, from time (t0) to time (t1), and from time (t9) to time (t10)). There is an embodiment provided for describing this case (which is depicted in FIGS. 7A to 7G).

Figure 3A:
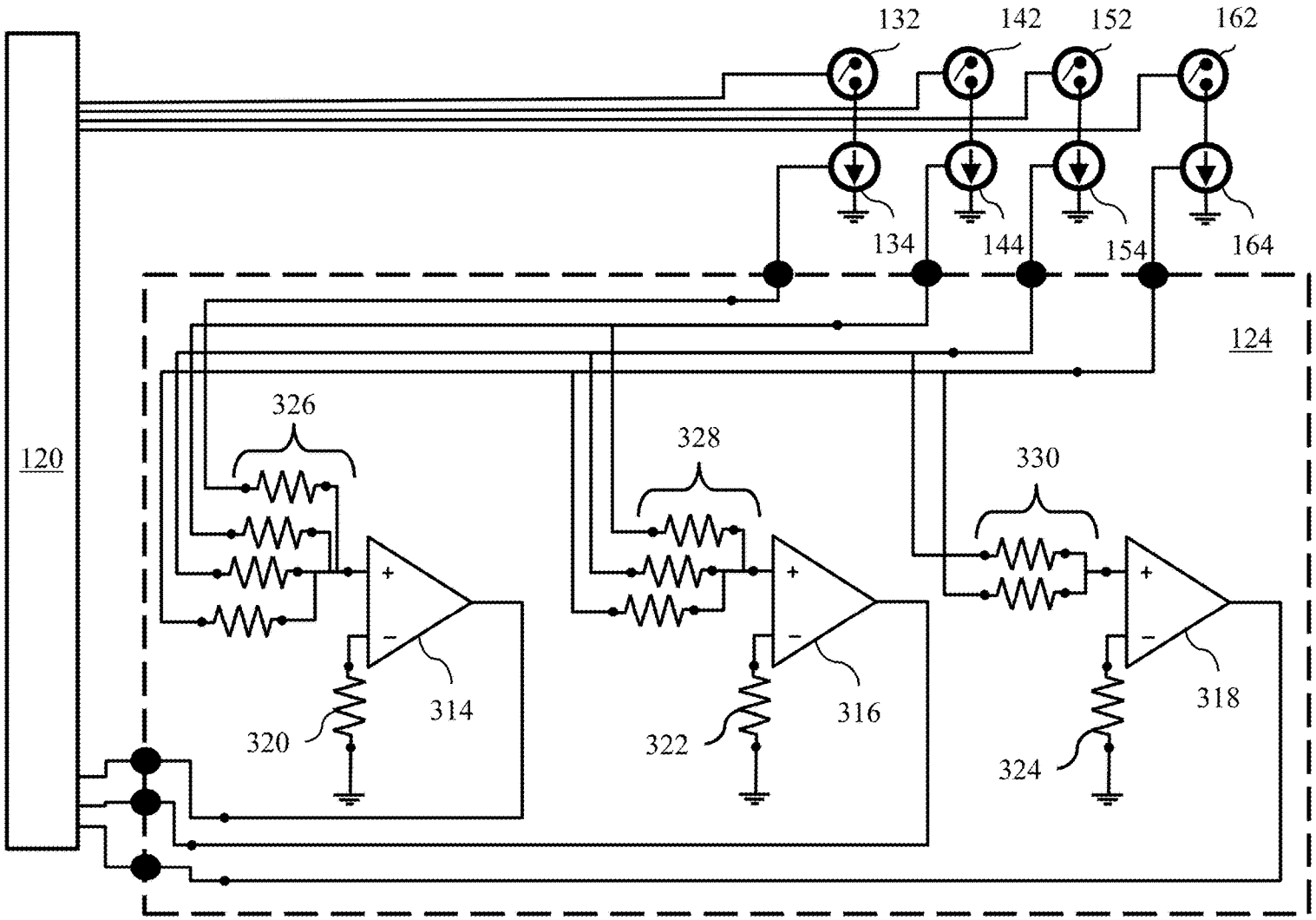
FIG. 3A depicts a schematic view of an embodiment of a segment detection unit for utilization with the lamp-control circuit of FIG. 1A.

FIG. 3A depicts a schematic view of an embodiment of a segment detection unit 124 for utilization with the lamp-control circuit 100 of FIG. 1A.

FIG. 3B depicts the states of controllable switches for utilization with the segment detection unit 124 of FIG. 3A.

Referring to the embodiment as depicted in FIG. 3A, the segment detection unit 124 includes a synergistic combination of a first operational amplifier 314, a second operational amplifier 316, a third operational amplifier 318, a third resistor 320, a fourth resistor 322, a fifth resistor 324, a first resistor divider circuit 326, a second resistor divider circuit 328 and a third resistor divider circuit 330. Preferably, the first main controllable switch 114, the second main controllable switch 116, the main current source 118, the control logic unit 120, the first controllable switch 132, the first controllable current source 134, the comparator 302, the first operational amplifier 314, the second operational amplifier 316, and the third operational amplifier 318 are all integrated in a custom manufactured integrated circuit assembly.

The first operational amplifier 314, the second operational amplifier 316, and the third operational amplifier 318 are configured to (A) sense to the voltages of the segments of the LED array 128 (in real time), and (B) provide the sensed voltages to the control logic unit 120.

The control logic unit 120 is configured to calculate and determine the status (ON/OFF) of the first controllable switch 132, the second controllable switch 142, the third controllable switch 152, and the fourth controllable switch 162.

A self-adaptive method is utilized to control the voltage of the segments of the LED array 128.

The first controllable switch 132, the second controllable switch 142, the third controllable switch 152, and the fourth controllable switch 162 are turned ON by default when the circuit is powered on.

The LED voltage (LED_1) is the voltage of the first LED segment 130. The LED voltage (LED_2) is the voltage sum of the first LED segment 130, and the second LED segment 140. The LED voltage (LED_3) is the voltage sum of the first LED segment 130, the second LED segment 140, and the third LED segment 150. The LED voltage (LED_4) is the voltage sum of the first LED segment 130, the second LED segment 140, the third LED segment 150, and the fourth LED segment 160.

The first resistor divider circuit 326, the third resistor 320, and the first operational amplifier 314 constitute the first LED segment detection circuit.

The output of the first operational amplifier 314 is the sampling current sum of the first controllable current source 134, the second controllable current source 144, the third controllable current source 154, and the fourth controllable current source 164. The output of the first operational amplifier 314 is electrically connected the control logic unit 120.

The second resistor divider circuit 328, the fourth resistor 322, and the second operational amplifier 316 constitute the second LED segment detection circuit.

The output of the second operational amplifier 316 is the sampling current sum of the second controllable current source 144, the third controllable current source 154, and the fourth controllable current source 164. The output of the second operational amplifier 316 is electrically connected to the control logic unit 120.

The third resistor divider circuit 330, the fifth resistor 324, and the third operational amplifier 318 constitute the third LED segment detection circuit.

The output of the third operational amplifier 318 is the sampling current sum of the third controllable current source 154, and the fourth controllable current source 164. The output of the third operational amplifier 318 is electrically connected to the control logic unit 120.

For the case where the rectifier output voltage is greater than or equal to (≥) the LED voltage (LED_4), the following are true: (A) the current flows into each branch of the first controllable current source 134, the second controllable current source 144, the third controllable current source 154, and the fourth controllable current source 164, (B) the control logic unit 120 will turn OFF the first controllable switch 132, the second controllable switch 142, the third controllable switch 152, and turn ON the fourth controllable switch 162, and (C) the current flows from the first LED segment 130, the second LED segment 140, the third LED segment 150, the fourth LED segment 160, the fourth controllable switch 162, and the fourth controllable current source 164 to the electrical ground.

For the case where the LED voltage (LED_4) is greater than (>) the rectifier output voltage, and the rectifier output voltage is greater than or equal to (≥) the LED voltage (LED_3), the following are true: (A) current flows into each branch of the first controllable current source 134, the second controllable current source 144, and the third controllable current source 154, (B) the control logic unit 120 will turn OFF the first controllable switch 132, the second controllable switch 142, and turn ON the third controllable switch 152, and (C) the current flows from the first LED segment 130, the second LED segment 140, the third LED segment 150, the third controllable switch 152, and the third controllable current source 154 to the electrical ground.

For the case where the LED voltage (LED_3) is greater than (>) the rectifier output voltage, and the rectifier output voltage is greater than or equal to (≥) the LED voltage (LED_2), the following are true: (A) current flows into each branch of the first controllable current source 134 and the second controllable current source 144, (B) the control logic unit 120 will turn OFF the first controllable switch 132, and turn ON the second controllable switch 142, and (C) the current flows from the first LED segment 130, the second LED segment 140, the second controllable switch 142, and the second controllable current source 144 to the electrical ground.

For the case where the LED voltage (LED_2) is greater than (>) the rectifier output voltage, and the rectifier output voltage is greater than or equal to (≥) the LED voltage (LED_1), the following are true: (A) current flows into the branch of the first controllable current source 134, and the control logic unit 120 will let the first controllable switch 132 is turned ON, and (B) the current flows from the first LED segment 130, the first controllable switch 132, and the first controllable current source 134 to the electrical ground.

Figure 4:
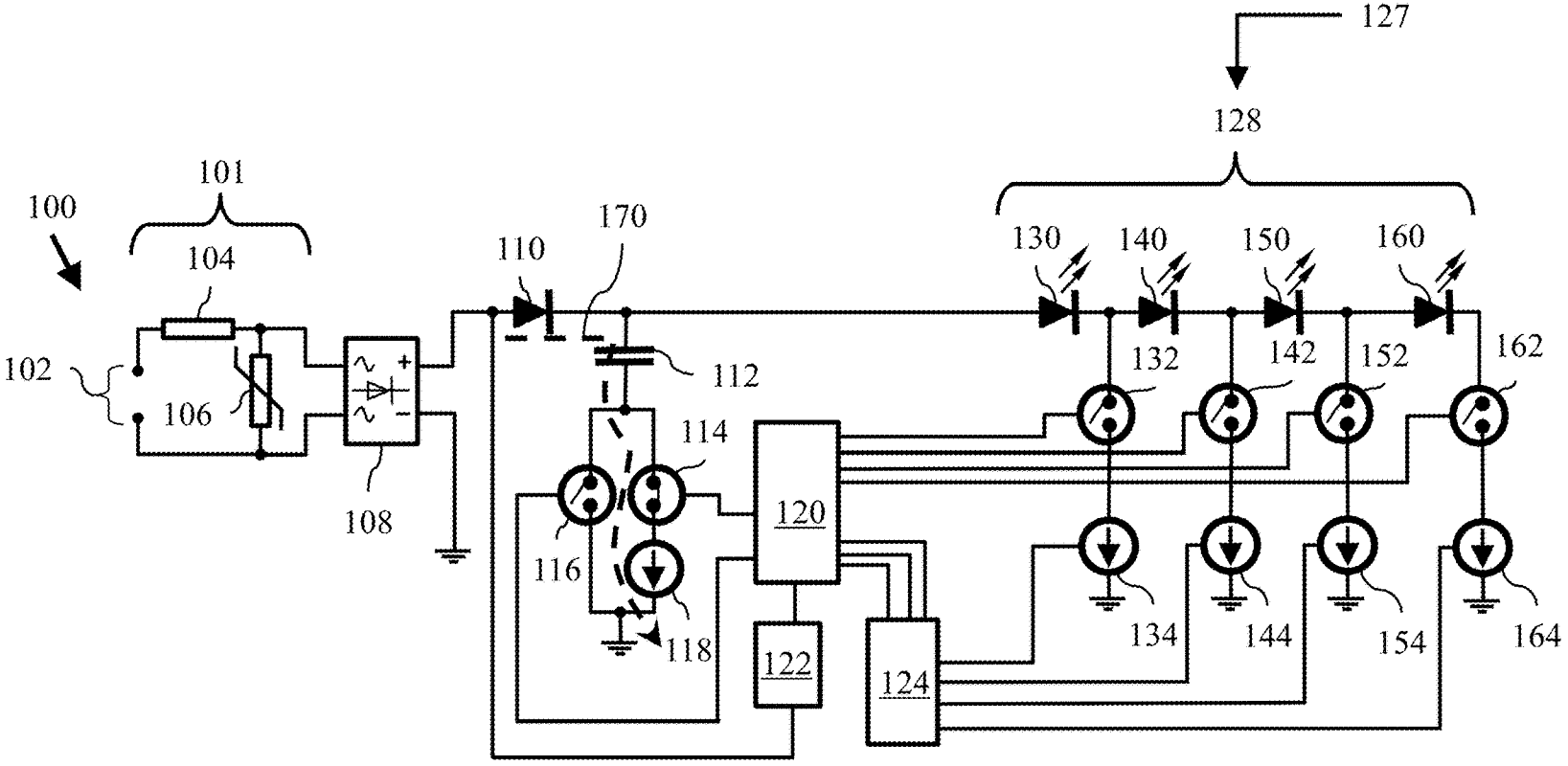
FIG. 4 depicts a schematic view of an embodiment of the lamp-control circuit of FIG. 1A in accordance with a first operation mode.

FIG. 4 depicts a schematic view of an embodiment of the lamp-control circuit 100 of FIG. 1A in accordance with a first operation mode.

Referring to the embodiment as depicted in FIG. 4, the first main controllable switch 114 is placed in an ON condition (such as, the closed condition or the electrical-condition condition), and the second main controllable switch 116 is placed in an OFF condition (opened condition). For the case where the amplitude of the input voltage is higher than a forward voltage (or turn on voltage) of the fourth segment of the LED array 128, the first main controllable switch 114 is closed and the second main controllable switch 116 is open, so that the lamp-control circuit 100 is configured to charge energy to the energy-storage device 112.

The first current path 170 indicates that the energy-storage device 112 is charging.

Figure 5:
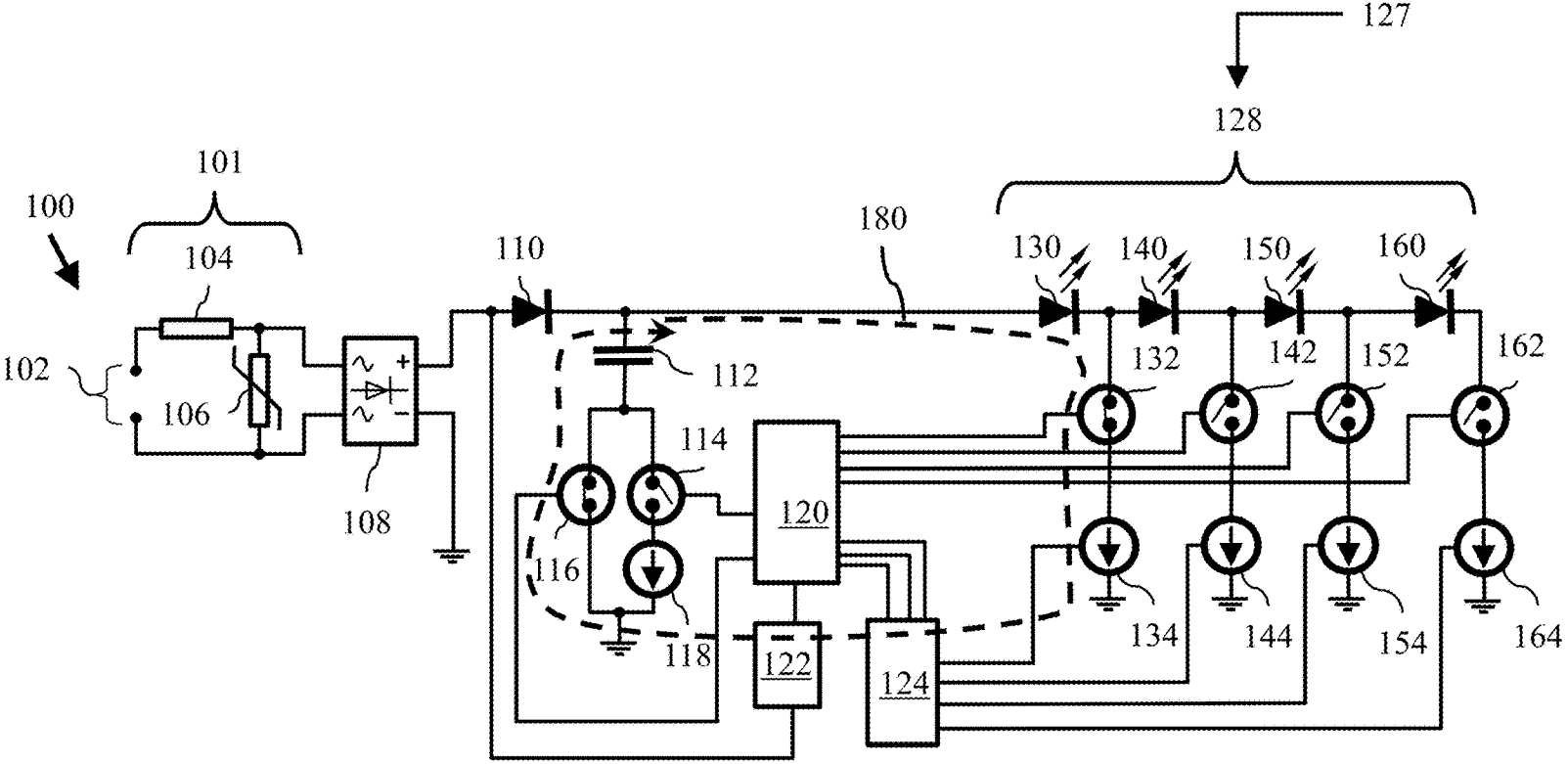
FIG. 5 depicts a schematic view of an embodiment of the lamp-control circuit of FIG. 1A in accordance with a second operation mode.

FIG. 5 depicts a schematic view of an embodiment of the lamp-control circuit 100 of FIG. 1A in accordance with a second operation mode.

Referring to the embodiment as depicted in FIG. 5, the first main controllable switch 114 is placed in an OFF condition (opened condition), and the second main controllable switch 116 is placed in an ON condition (closed condition). For the case where the amplitude of the input line voltage is lower than a certain value (a predetermined value), the first main controllable switch 114 is open and the second main controllable switch 116 is closed, so that the energy-storage device 112 is configured to discharge the energy to the first segment of the LED array 128.

The second current path 180 indicates that the energy-storage device 112 is discharging.

Figure 6:
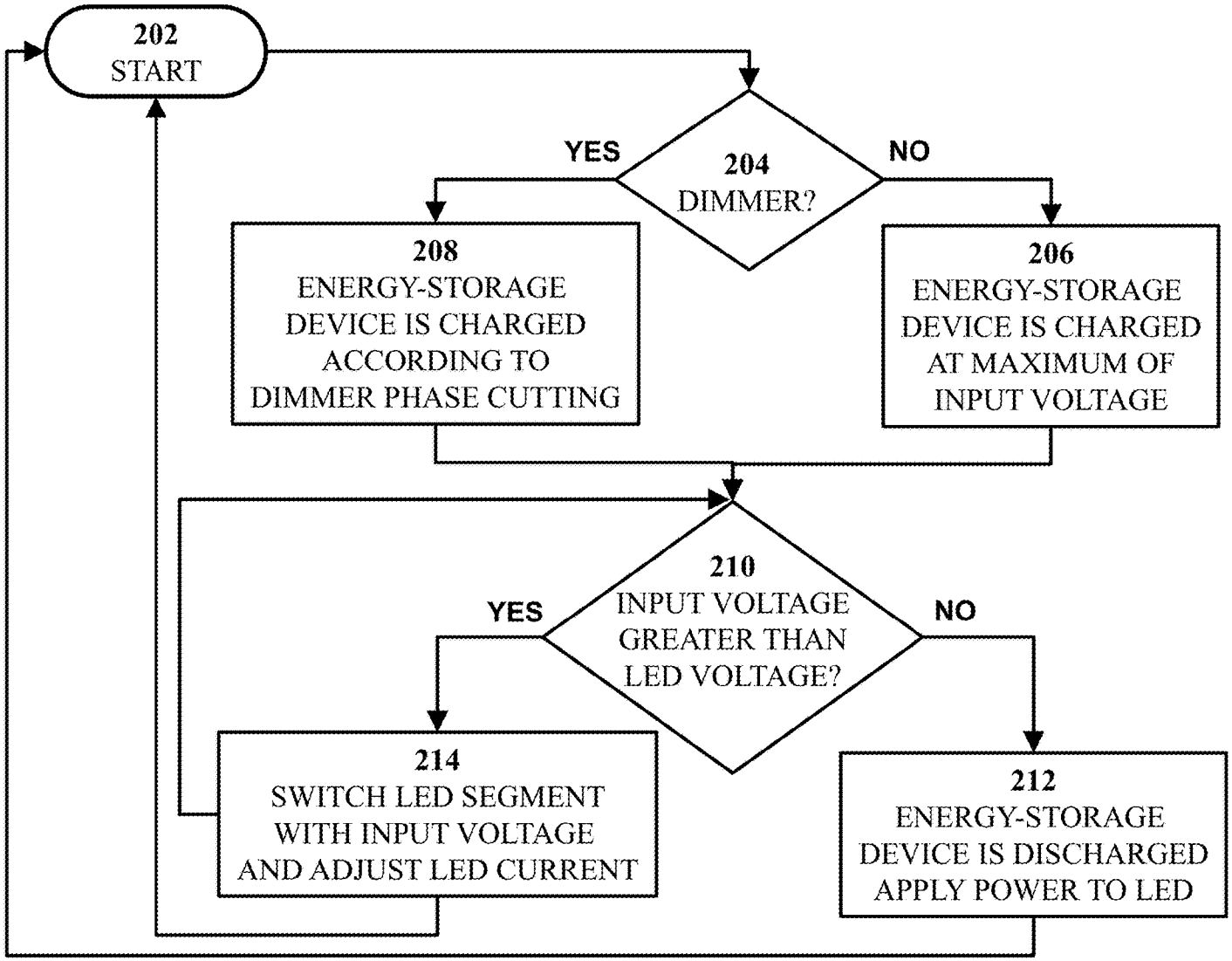
FIG. 6 depicts a schematic view of an embodiment of a flow chart for utilization by a control logic unit of the lamp-control circuit of FIG. 1A.

FIG. 6 depicts a schematic view of an embodiment of a flow chart for utilization by a control logic unit 120 of the lamp-control circuit 100 of FIG. 1A.

Referring to the embodiment as depicted in FIG. 6, the dimmer detection unit 122 is configured to (A) keep sampling (continuously sample or monitor) the rectifier output voltage and the rectifier output current (of the rectifier bridge 108), and (B) sense (detect) whether there the dimmer module 900 is (or is not) electrically connected to the lamp-control circuit 100.

For the case where there is the dimmer module 900 is not electrically connected to the lamp-control circuit 100, the lamp-control circuit 100 is configured to charge energy to the energy-storage device 112 at the maximum magnitude of the input voltage.

For the case where there is the dimmer module 900 is electrically connected to the lamp-control circuit 100, the lamp-control circuit 100 is configured to charge energy to the energy-storage device 112 according to input voltage after the dimmer phase cutting.

For the case where the magnitude of the voltage after the rectifier bridge 108 is lower than the magnitude of the voltage applied across the LED array 128, the energy-storage device 112 is configured to discharge the energy to the LED array 128.

For the case where the magnitude of the voltage after the rectifier bridge 108 is higher than the magnitude of the voltage applied across the LED array 128, the lamp-control circuit 100 is configured to control the LED array 128 so that a relatively constant light output is emitted by the LED array 128 for each cycle of the input voltage.

Referring to the embodiment as depicted in FIG. 6, there are depicted operations that are executable by the control logic unit 120 (the embodiment of which is depicted in FIG. 1A). A first operation 202 includes starting operation(s), such as initialization, error checking, etc., of the lamp-control circuit 100 (the embodiment of which is depicted in FIG. 1A). Operational control is transferred to the second operation 204 once the first operation 202 is completed.

A second operation 204 includes directing (urging) the control logic unit 120 to determine whether there is a dimmer module 900 (the embodiment of which is depicted in FIG. 1B) electrically connected to the lamp-control circuit 100 (connected to the LED array 128 via the lamp-control circuit 100).

For the case where the second operation 204 urges the control logic unit 120 to make a determination that the dimmer module 900 is not electrically connected to the lamp-control circuit 100 (the embodiment of which is depicted in FIG. 1C), operational control is transferred to the third operation 206.

For the case where the second operation 204 urges the control logic unit 120 to make a determination that the dimmer module 900 is electrically connected to the lamp-control circuit 100 (the embodiment of which is depicted in FIG. 1B), operational control is transferred to the fourth operation 208.

A third operation 206 includes urging the control logic unit 120 to control the operation of the first main controllable switch 114 and the second main controllable switch 116 (the embodiment of which is depicted in FIG. 4) in such a way that the energy-storage device 112 is charged to, preferably, a maximum value of the input voltage (such as, 120 Volts AC). Once the third operation 206 is completed, operational control is transferred to the fifth operation 210.

A fourth operation 208 includes urging the control logic unit 120 to control the operation of the first main controllable switch 114 and the second main controllable switch 116 (the embodiment of which is depicted in FIG. 4) in such a way that the energy-storage device 112 is charged according to a dimmer phase cutting (dimmer phase cutting is associated with the dimmer module 900). Once the fourth operation 208 is completed, operational control is transferred to the fifth operation 210.

A fifth operation 210 includes urging the control logic unit 120 to determine whether the input voltage is greater than the LED voltage.

For the case where the fifth operation 210 urges the control logic unit 120 to determine that the input voltage is NOT greater than the LED voltage, operational control is transferred to the sixth operation 212.

For the case where the fifth operation 210 urges the control logic unit 120 to determine that the input voltage is greater than the LED voltage, operational control is transferred to the seventh operation 214.

A sixth operation 212 includes urging the control logic unit 120 to control operation of the first main controllable switch 114 and the second main controllable switch 116 (the embodiment of which is depicted in FIG. 5) in such a way that the energy-storage device 112 is discharging by applying power to the LED array 128. Once the sixth operation 212 is completed, operational control is transferred to the first operation 202.

A seventh operation 214 includes urging the control logic unit 120 to (A) switch the LED segments (130, 140, 150, 160) with the input voltage, and (B) adjust the LED current. Once the seventh operation 214 is completed, operational control is transferred to the first operation 202.

Non-dimming Operation Mode

FIGS. 7A-7G depict schematic views of operational parameters associated with a non-dimming operation mode of the lamp-control circuit 100 of FIG. 1A.

Figure 7A:
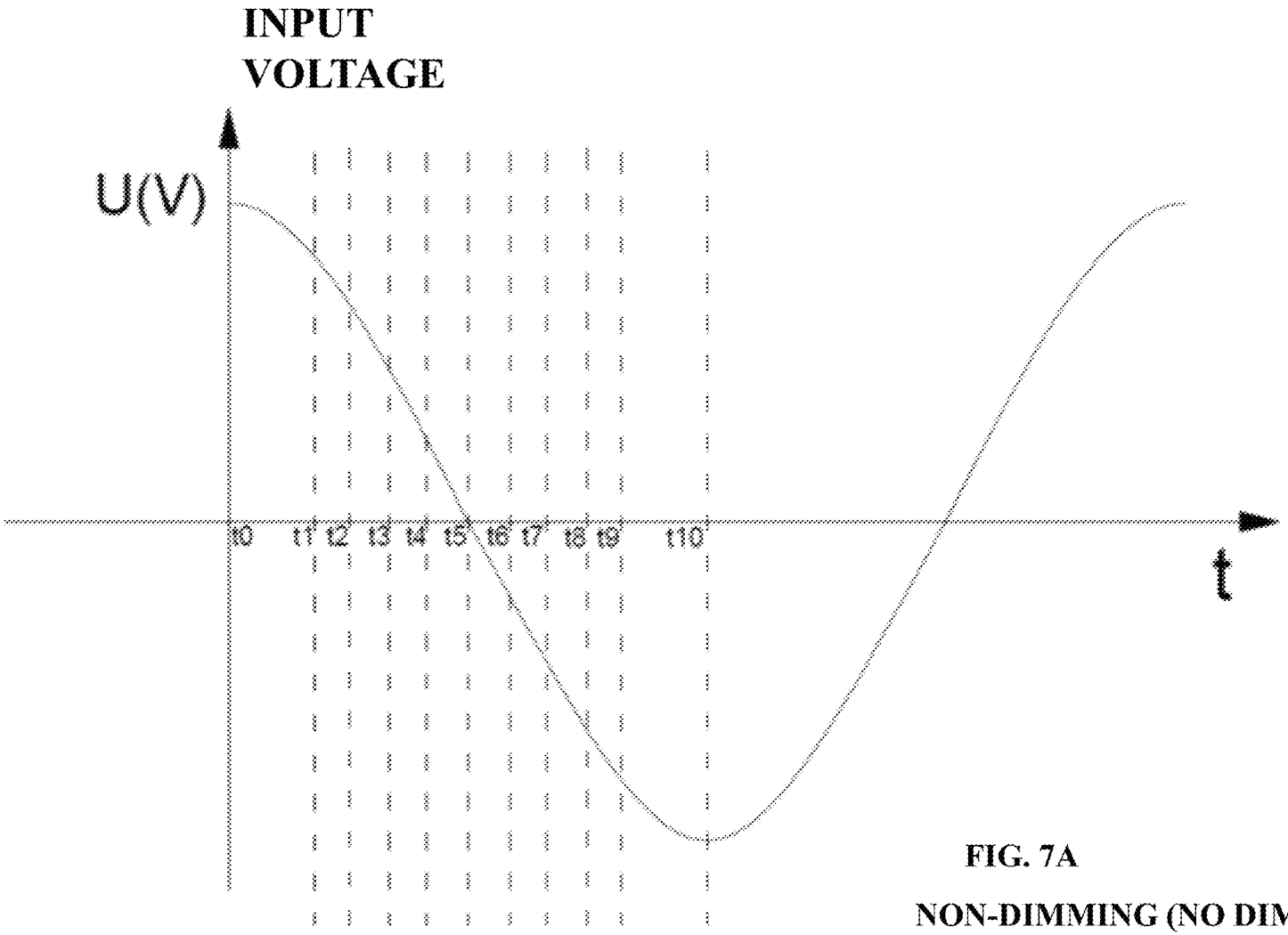
FIGS. 7A-7G depict schematic views of operational parameters associated with a non-dimming operation mode of the lamp-control circuit of FIG. 1A.

Referring to the embodiment as depicted in FIG. 7A, the input voltage, U(V), is depicted for the non-dimming operation mode. The input voltage (also called the output voltage of the electrical source 800) is applied across the power terminals 102. The x-axis represents time, and the y-axis represents the input voltage. The input voltage is depicted as a waveform. For instance, the input voltage includes (forms) a cosine function under the non-dimming operation mode. For the non-dimming operation mode, the light output of the LED array 128 is not dimmed (attenuated, zero percent dimming). Preferably, the light output to be emitted by the LED array 128 is set at a first predetermined level of light output, such as a maximum level of light output, or at 100 percent light output (during the non-dimming operation mode).

Figure 7B:
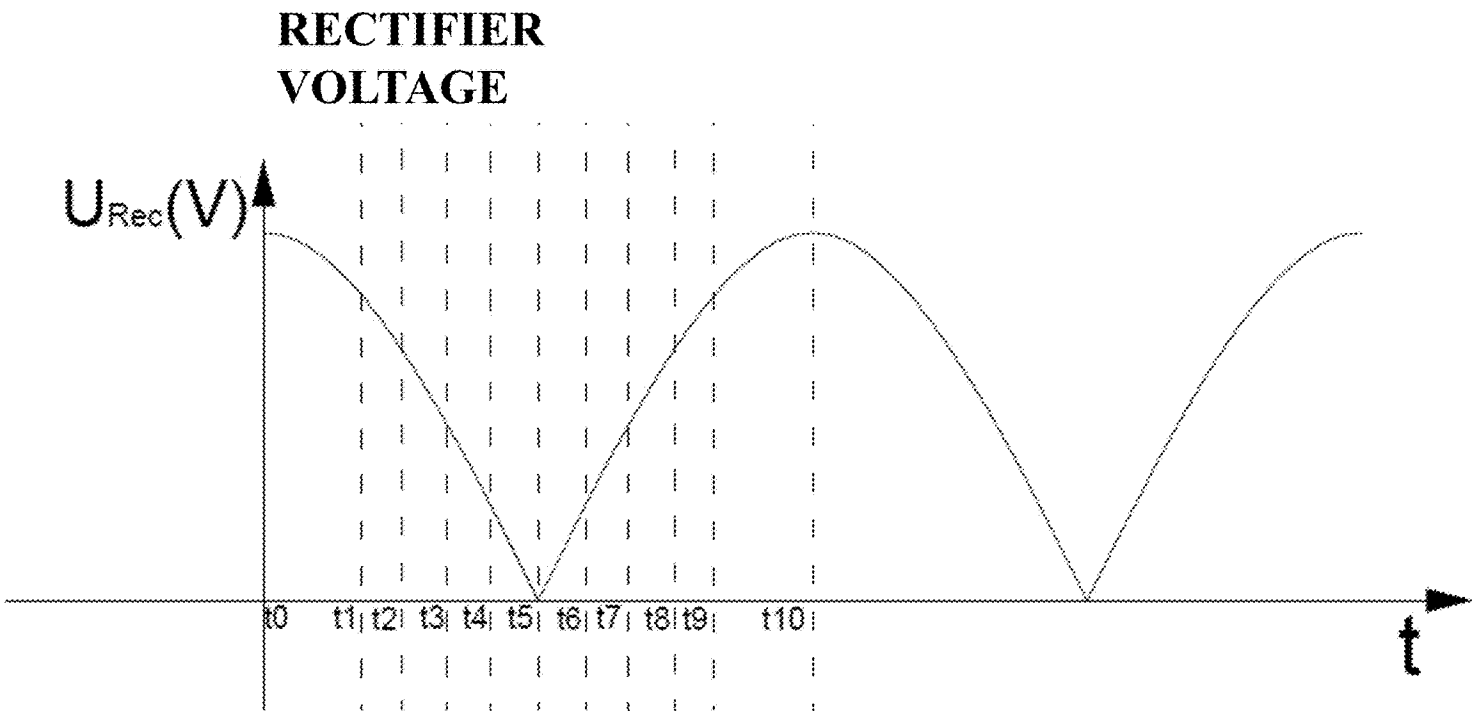

Referring to the embodiment as depicted in FIG. 7B, the rectifier output voltage, UREC(V), is depicted for the non-dimming operation mode. The rectifier output voltage is provided (applied) across the output terminals of the rectifier bridge 108. The x-axis represents time, and the y-axis represents the rectifier output voltage. The rectifier output voltage is depicted as a waveform.

Figure 7C:
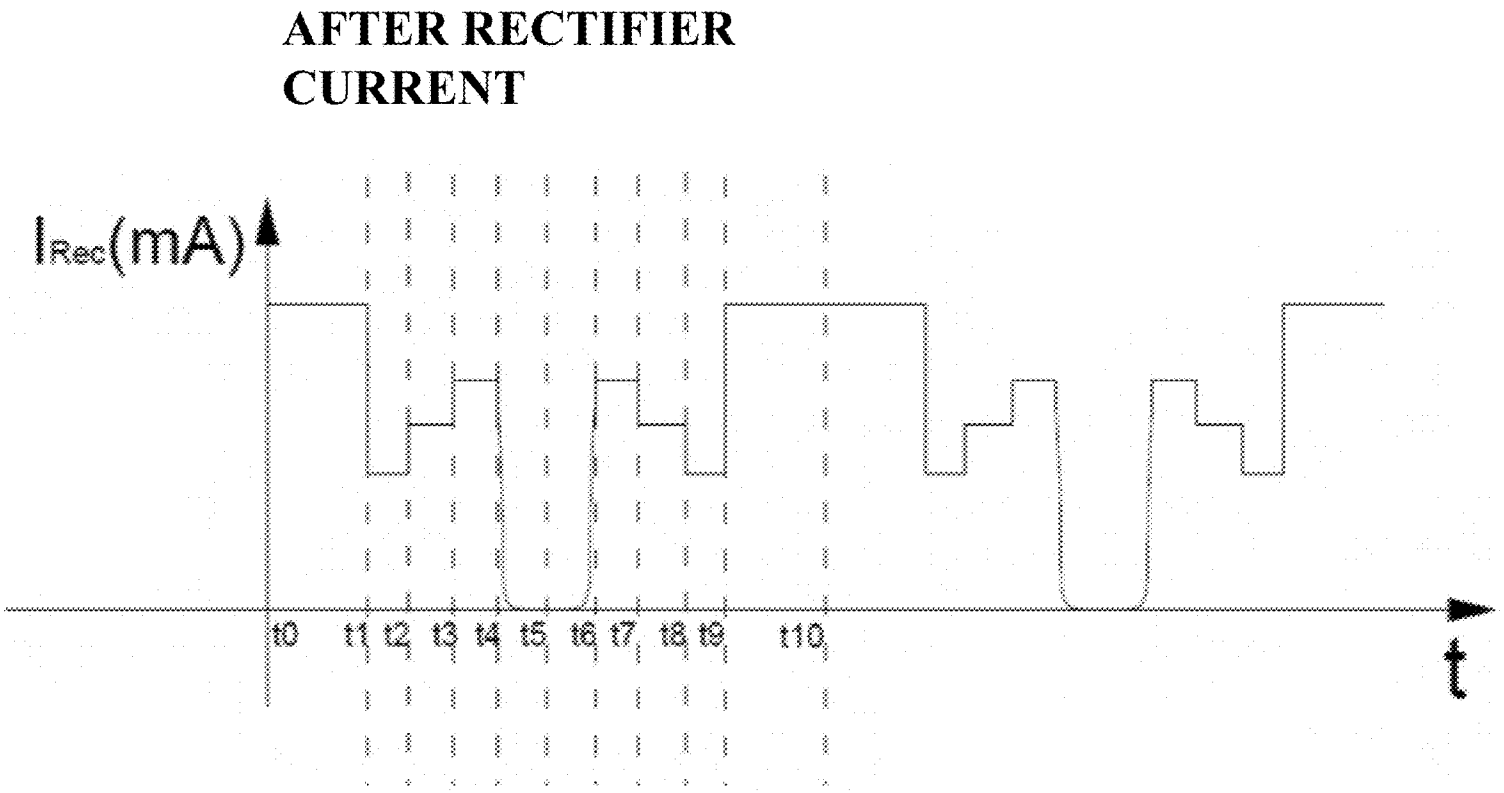

Referring to the embodiment as depicted in FIG. 7C, the rectifier output current, IREC(mA or milliampere), is depicted for the non-dimming operation mode. The rectifier output current flows from (through) the output terminals of the rectifier bridge 108. The x-axis represents time, and the y-axis represents the rectifier output current. The rectifier output current is represented by a waveform. The rectifier output current equals the capacitor current plus the LED current.

Figure 7D:
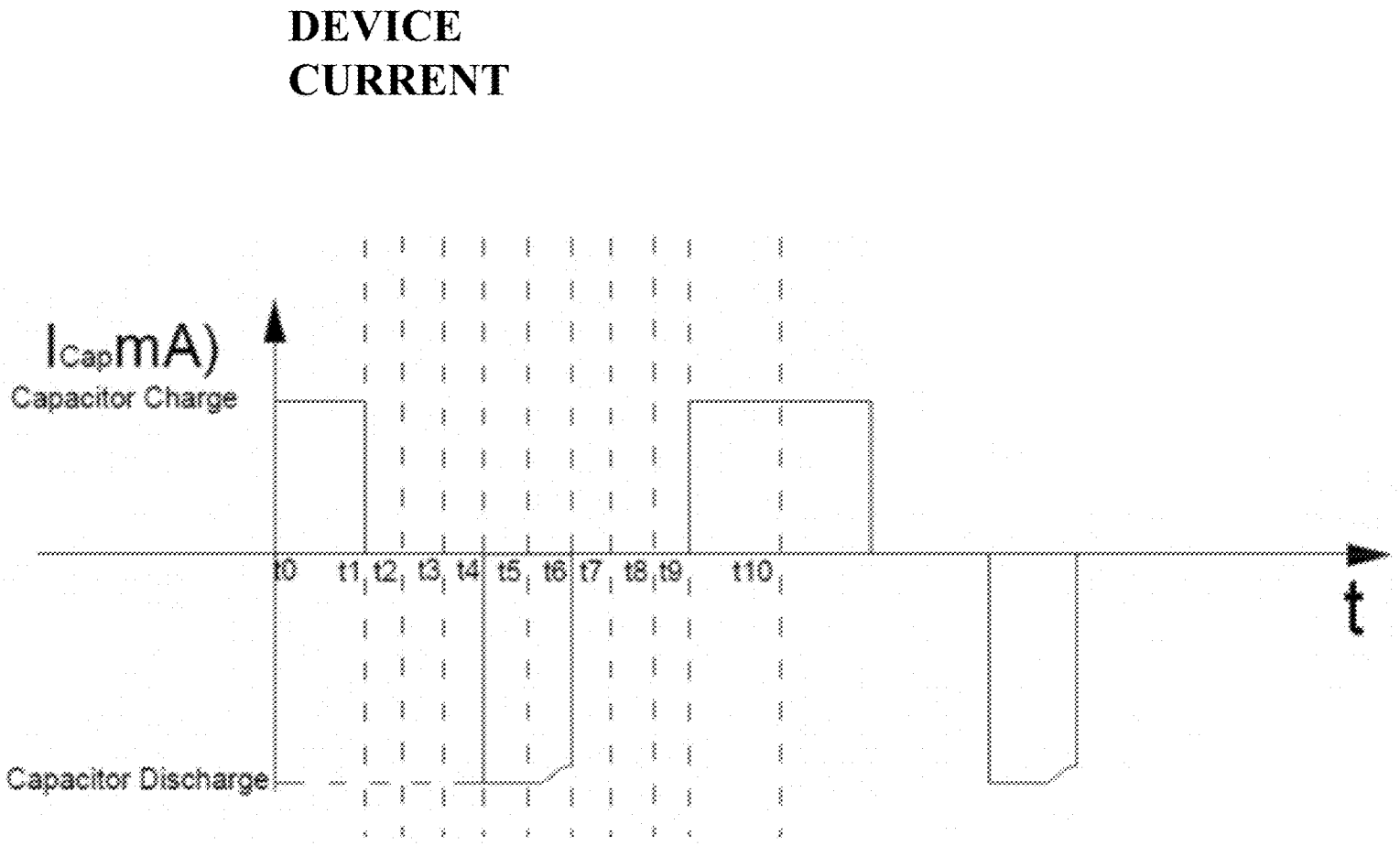

Referring to the embodiment as depicted in FIG. 7D, the capacitor current, ICAP (mA), is depicted for the non-dimming operation mode. The capacitor current, in use, flows through the energy-storage device 112. A positive value of the capacitor current indicates the energy-storage device 112 is charging. A negative value of the capacitor current indicates the energy-storage device 112 is discharging. The capacitor current, in use, flows into the energy-storage device 112, and thereby the energy-storage device 112 is charged or is charging. The capacitor current, in use, flows out from the energy-storage device 112, and thereby the energy-storage device 112 is discharged or is discharging. The x-axis represents time, and the y-axis represents the capacitor current. The capacitor current is represented by a waveform.

The LED current (LED_1) is a value that represents the current flowing through the first LED segment 130. The LED current (LED_2) is a value that represents the current flowing through the second LED segment 140. The LED current (LED_3) is a value that represents the current flowing through the third LED segment 150. The LED current (LED_4) is a value that represents the current flowing through the fourth LED segment 160.

The LED voltage (LED_1) is a value that represents the voltage across the first LED segment 130. The LED voltage (LED_2) is a value that represents the sum of the voltages across the first LED segment 130 and the second LED segment 140. The LED voltage (LED_3) is a value that represents the sum of the voltages across the first LED segment 130, the second LED segment 140 and the third LED segment 150. The LED voltage (LED_4) is a value that represents the sum of the voltages across the first LED segment 130, the second LED segment 140, the third LED segment 150 and the fourth LED segment 160.

For the case where the rectifier output voltage is greater than or equal to (≥) the LED voltage (LED_4), the following are true: (A) the capacitor current (flowing through the energy-storage device 112) is positive, (B) the first main controllable switch 114 is ON, (C) the second main controllable switch 116 is OFF, and (D) the rectifier output voltage is utilized for charging the energy-storage device 112.

For the case where the rectifier output voltage is less than (<) the LED voltage (LED_1), the following are true: (A) the capacitor current (that flows through the energy-storage device 112) is negative, (B) the first main controllable switch 114 is OFF, (C), the second main controllable switch 116 is ON, (D) the energy-storage device 112 is discharging to the first LED segment 130, and (E) the capacitor current equals (=) the negative value of the LED current (LED_1).

Figure 7E:
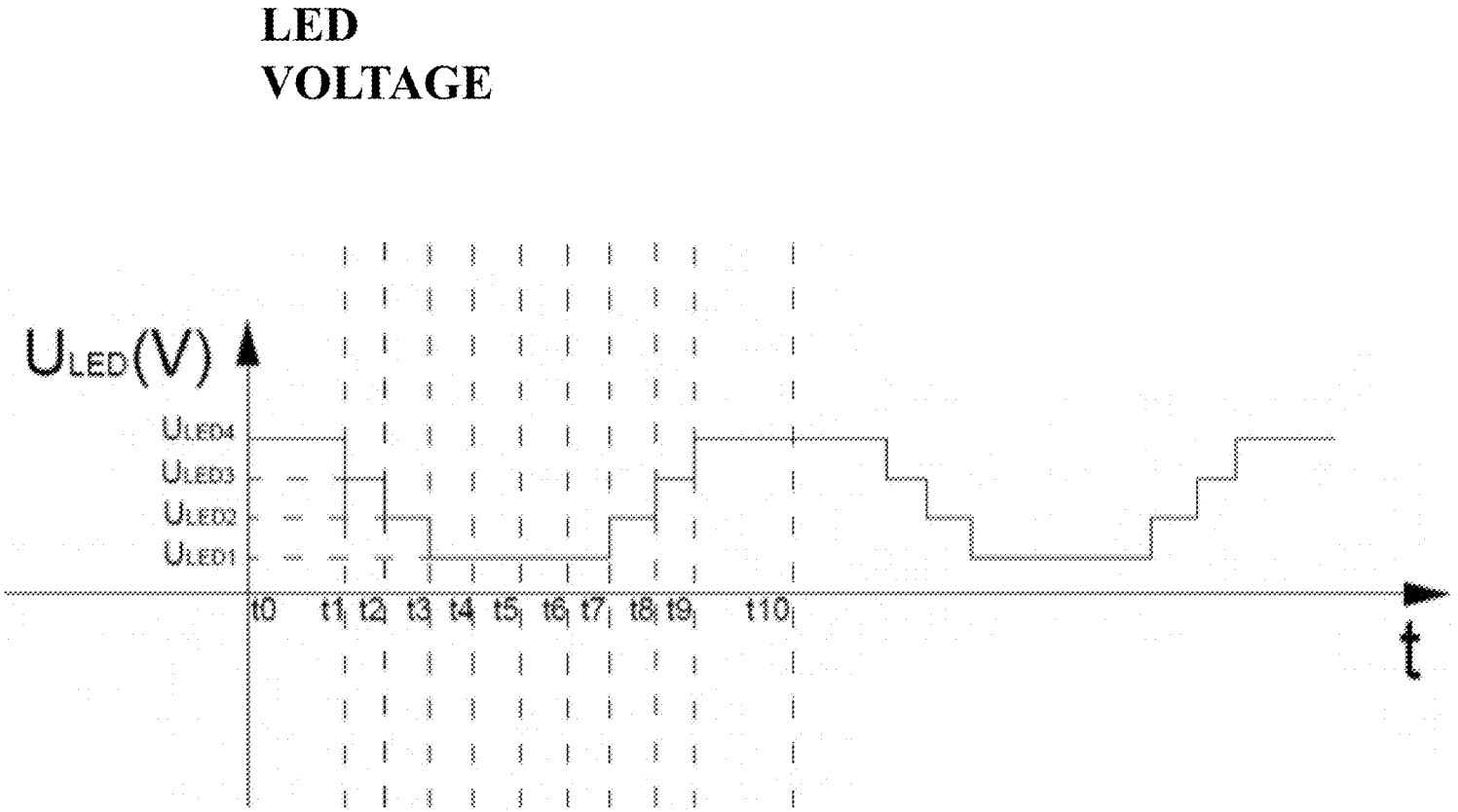

Referring to the embodiment as depicted in FIG. 7E, the LED voltage, ULED (V), is depicted for the non-dimming operation mode. The LED voltage is across the LED array 128. The x-axis represents time, and the y-axis represents the LED voltage. The LED voltage is represented by a waveform. The LED voltage will be changed from the LED voltage (LED_1) to the LED voltage (LED_4) according to the value of the rectifier output voltage (which is to be detected and determined by the control logic unit 120).

Figure 7F:
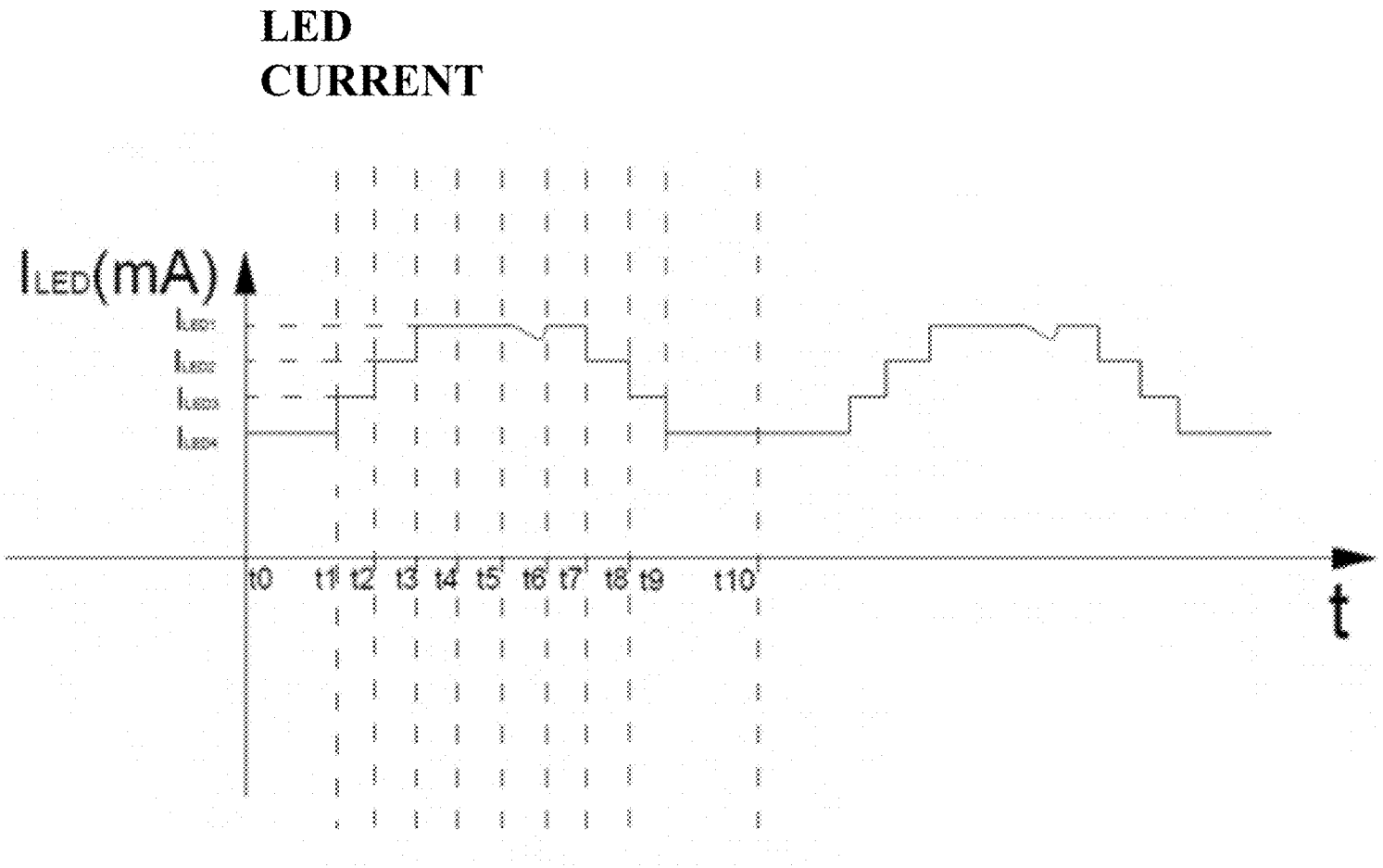

Referring to the embodiment as depicted in FIG. 7F, the LED current, ILED (mA), is depicted for the non-dimming operation mode. The LED current flows through the LED array 128. The x-axis represents time, and the y-axis represents the LED current. The LED current is represented by a waveform. The LED current is self-adaptive according to the rectifier output voltage.

For the case where the rectifier output voltage (of the rectifier bridge 108) is greater than or equal to (≥) the LED voltage (LED_4), the following conditions are true: (A) the first controllable switch 132 is OFF, (B) the second controllable switch 142 is OFF, (C) the third controllable switch 152 is OFF, (D) the fourth controllable switch 162 is ON, and (E) the LED current equals (=) the LED current (LED_4).

For the case where the LED voltage (LED_4) is greater than (>) the rectifier output voltage, and the rectifier output voltage is greater than or equal to (≥) the LED voltage (LED_3), the following conditions are true: (A) the first controllable switch 132 is OFF, (B) the second controllable switch 142 is OFF, (C) the third controllable switch 152 is ON, (D) the fourth controllable switch 162 is OFF, and (E) the LED current equals (=) the LED current (LED_3).

For the case where the LED voltage (LED_3) is greater than (>) the rectifier output voltage, and the rectifier output voltage is greater than or equal to (≥) the LED voltage (LED_2), the following conditions are true: (A) the first controllable switch 132 is OFF, (B) the second controllable switch 142 is ON, (C) the third controllable switch 152 is OFF, (D) the fourth controllable switch 162 is OFF, and (E) the LED current equals (=) the LED current (LED_2).

For the case where the LED voltage (LED_2) is greater than (>) the rectifier output voltage, and the rectifier output voltage is greater than or equal to (≥) the LED voltage (LED_1), the following conditions are true: (A) the first controllable switch 132 is ON, (B) the second controllable switch 142 is OFF, (C) the third controllable switch 152 is OFF, (D) the fourth controllable switch 162 is OFF, and (E) the LED current equals (=) the LED current (LED_1).

For the case where the rectifier output voltage is less than (<) the LED voltage (LED_1), the following conditions are true: (A) the energy-storage device 112 is discharging the capacitor current to the first LED segment 130, (B) the first controllable switch 132 is ON, (C) the second controllable switch 142 is OFF, (D) the third controllable switch 152 is OFF, (E) the fourth controllable switch 162 is OFF, and (F) the LED current equals (=) the LED current (LED_1).

Figure 7G:
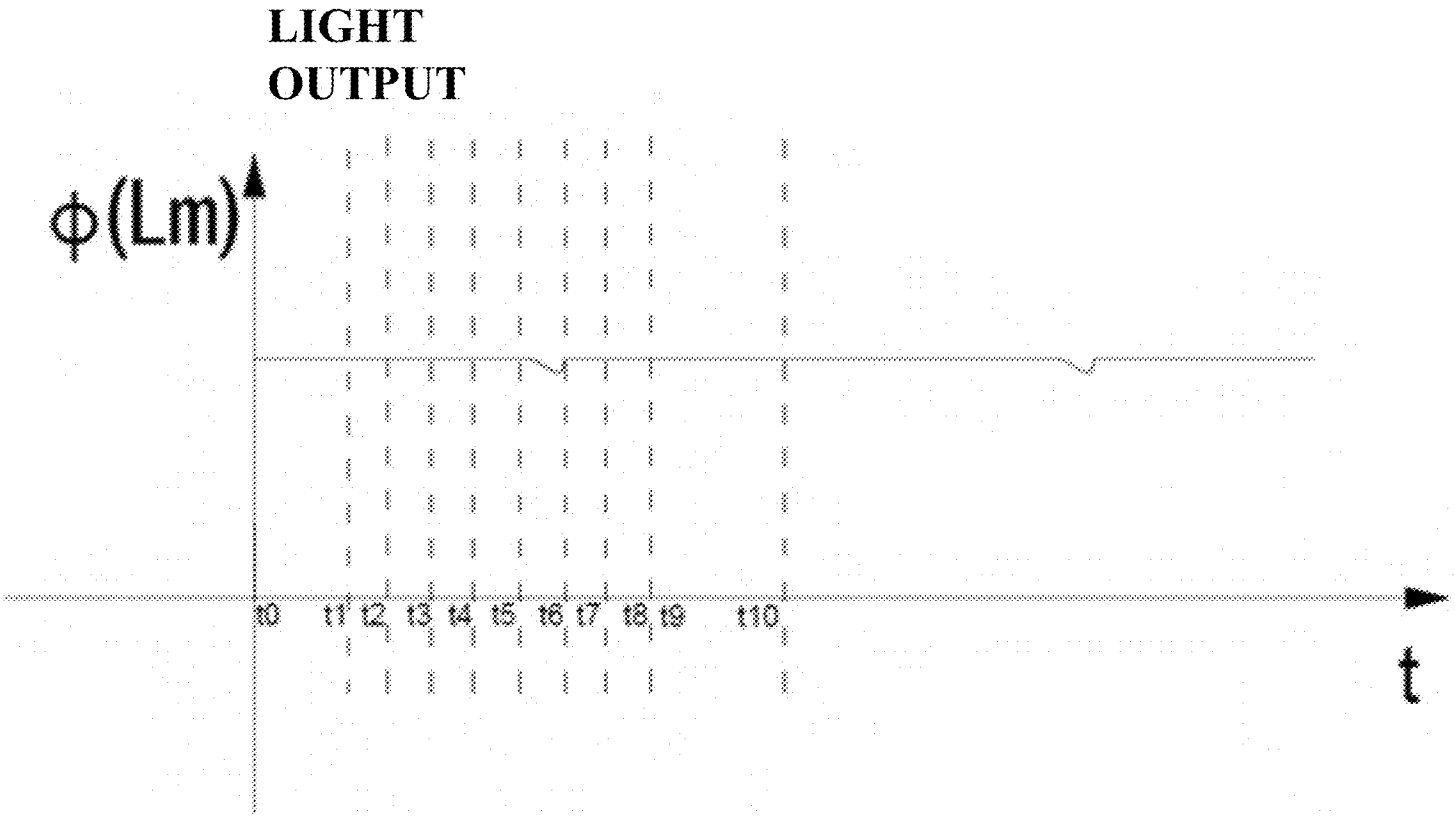

Referring to the embodiment as depicted in FIG. 7G, the light output is depicted for the non-dimming operation mode. The light output is emitted by the LED array 128. The x-axis represents time, and the y-axis represents the light output. The light output is represented by a waveform.

Sequence Analysis from Time (t0) to Time (t10) For Non-dimming Operation Mode Operation Mode (A) Exists (Extends) from Time (t0) to Time (t1).

From time (t0) to time (t1), the following conditions are true: (A) the rectifier output voltage is greater than or equal to (≥) the LED voltage (LED_4), (B) the first main controllable switch 114 is ON, (C) the second main controllable switch 116 is OFF, (D) the rectifier output voltage is utilized for (i) charging the energy-storage device 112, and (ii) powering the LED array 128, (E) the first controllable switch 132 is OFF, (F) the second controllable switch 142 is OFF, (G) the third controllable switch 152 is OFF, and (H) the fourth controllable switch 162 is ON.

From time (t0) to time (t1), the following conditions exist: (A) the LED voltage equals (=) the LED voltage (LED_4), (B) the LED current equals (=) the LED current (LED_4), and (C) the rectifier output current equals (=) the LED current (LED_4) plus the capacitor current (flowing through the energy-storage device 112).

Operation Mode (B) Exists from Time (t1) to Time (t2).

From time (t1) to time (t2), the following conditions are true: (A) the LED voltage (LED_4) is greater than (>) the rectifier output voltage, and the rectifier output voltage is greater than or equal to (≥) the LED voltage (LED_3), (B) the first main controllable switch 114 is OFF, (C) the second main controllable switch 116 is OFF, (D) the energy-storage device 112 is open circuit, (E) the rectifier output voltage is utilized to power the LED array 128, (F) the first controllable switch 132 is OFF, (G) the second controllable switch 142 is OFF, (H) the third controllable switch 152 is ON, and the (I) the fourth controllable switch 162 is OFF.

From time (t1) to time (t2), the following conditions exist: (A) the LED voltage equals (=) the LED voltage (LED_3), (B) the LED current equals (=) the LED current (LED_3), and (C) the rectifier output current equals (=) the LED current (LED_3).

Operation Mode (C) Exists from Time (t2) to Time (t3).

From time (t2) to time (t3), the following conditions are true: (A) the LED voltage (LED_3) is greater than (>) the rectifier output voltage, and the rectifier output voltage is greater than or equal to (≥) the LED voltage (LED_2), (B) the first main controllable switch 114 is OFF, (C) the second main controllable switch 116 is OFF, (D) the energy-storage device 112 is open circuit, (E) the rectifier output voltage is utilized to power the LED array 128, (F) the first controllable switch 132 is OFF, (G) the second controllable switch 142 is ON, (H) the third controllable switch 152 is OFF, and (I) the fourth controllable switch 162 is OFF.

From time (t2) to time (t3), the following conditions exist: (A) the LED voltage equals (=) the LED voltage (LED_2), (B) the LED current equals (=) the LED current (LED_2), and (C) the rectifier output current equals (=) the LED current (LED_2).

Operation Mode (D) Exists from Time (t3) to Time (t4).

From time (t3) to time (t4), the following conditions are true: (A) the LED voltage (LED_2) is greater than (>) the rectifier output voltage, and the rectifier output voltage is greater than or equal to (≥) the LED voltage (LED_1), (B) the first main controllable switch 114 is OFF, (C) the second main controllable switch 116 is OFF, (D) the energy-storage device 112 is open circuit, (E) the rectifier output voltage is used to power the LED array 128, (F) the first controllable switch 132 is ON, (G) the second controllable switch 142 is OFF, (H) the third controllable switch 152 is OFF, and (I) the fourth controllable switch 162 is OFF.

From time (t3) to time (t4), the following conditions exist: (A) the LED voltage equals (=) the LED voltage (LED_1), (B) the LED current equals (=) the LED current (LED_1), and (C) the rectifier output current equals (=) the LED current (LED_1).

Operation Mode (E) Exists from Time (t4) to Time (t6).

From time (t4) to time (t6), the following conditions are true: (A) the rectifier output voltage is less than (<) the LED voltage (LED_1), (B) the first main controllable switch 114 is OFF, (C) the second main controllable switch 116 is ON, (D) the energy-storage device 112 is discharging to the LED array 128, (E) the first controllable switch 132 is ON, (F) the second controllable switch 142 is OFF, (G) the third controllable switch 152 is OFF, and (H) the fourth controllable switch 162 is OFF.

From time (t4) to time (t6), the following conditions exist: (A) the LED voltage equals (=) the LED voltage (LED_1), (B) the LED current equals (=) the LED current (LED_1), (C) the capacitor current equals (=) the negative value of the LED current (LED_1), and (D) the rectifier output current equals (=) the capacitor current plus the LED current equals (=) zero (0).

Operation Mode (F) Exists from Time (t6) to Time (t7).

From time (t6) to time (t7), the following conditions are true: (A) the LED voltage (LED_2) is greater than (>) the rectifier output voltage, and the rectifier output voltage is greater than or equal to (≥) the LED voltage (LED_1), (B) the first main controllable switch 114 is OFF, (C) the second main controllable switch 116 is OFF, (D) the energy-storage device 112 is open circuit, (E) the rectifier output voltage is utilized to apply power to the LED array 128, (F) the first controllable switch 132 is ON, (G) the second controllable switch 142 is OFF, (H) the third controllable switch 152 is OFF, and (I) the fourth controllable switch 162 is OFF.

From time (t6) to time (t7), the following conditions exist: (A) the LED voltage equals (=) the LED voltage (LED_1), (B) the LED current equals (=) the LED current (LED_1), and (C) the rectifier output current equals (=) the LED current (LED_1).

Operation Mode (G) Exists from Time (t7) to Time (t8).

From time (t7) to time (t8), the following conditions are true: (A) the LED voltage (LED_3) is greater than (>) the rectifier output voltage, and the rectifier output voltage is greater than or equal to (≥) the LED voltage (LED_2), (B) the first main controllable switch 114 is OFF, (C) the second main controllable switch 116 is OFF, (D) the energy-storage device 112 is open circuit, (E) the rectifier output voltage is used to apply power to the LED array 128, (F) the first controllable switch 132 is OFF, (G) the second controllable switch 142 is ON, (H) the third controllable switch 152 is OFF, and (I) the fourth controllable switch 162 is OFF.

From time (t7) to time (t8), the following conditions exist: (A) the LED voltage equals (=) the LED voltage (LED_2), (B) the LED current equals (=) the LED current (LED_2), and (C) the rectifier output current equals (=) the LED current (LED_2).

Operation Mode (H) Exists from Time (t8) to Time (t9).

From time (t8) to time (t9), the following conditions are true: (A) the LED voltage (LED_4) is greater than (>) the rectifier output voltage, and the rectifier output voltage is greater than or equal to (≥) the LED voltage (LED_3), (B) the first main controllable switch 114 is OFF, (C) the second main controllable switch 116 is OFF, (D) the energy-storage device 112 is open circuit, (E) the rectifier output voltage is used to apply power to the LED array 128, (F) the first controllable switch 132 is OFF, (G) the second controllable switch 142 is OFF, (H) the third controllable switch 152 is ON, and (I) the fourth controllable switch 162 is OFF.

From time (t8) to time (t9), the following conditions exist: (A) the LED voltage equals (=) the LED voltage (LED_3), (B) the LED current equals (=) the LED current (LED_3), and (C) the rectifier output current equals (=) the LED current (LED_3).

Operation Mode (I) Exists from Time (t9) to Time (t10).

From time (t9) to time (t10), the following conditions are true: (A) the rectifier output voltage is greater than or equal to (≥) the LED voltage (LED_4), (B) the first main controllable switch 114 is ON, (C) the second main controllable switch 116 is OFF, (D) the rectifier output voltage is utilized for (i) charging the energy-storage device 112, and (ii) applying power to the LED array 128, (E) the first controllable switch 132 is OFF, (F) the second controllable switch 142 is OFF, (G) the third controllable switch 152 is OFF, and (H) the fourth controllable switch 162 is ON.

From time (t9) to time (t10), the following conditions exist: (A) the LED voltage equals (=) the LED voltage (LED_4), (B) the LED current equals (=) the LED current (LED_4), and (C) the rectifier output current equals (=) the LED current (LED_4) plus the capacitor current.

80 Percent Dimming Operation Mode

FIGS. 8A-8G depict schematic views of operational parameters associated with a dimming-down-to-80% operation mode of the lamp-control circuit 100 as depicted in FIG. 1A.

Figure 8A:
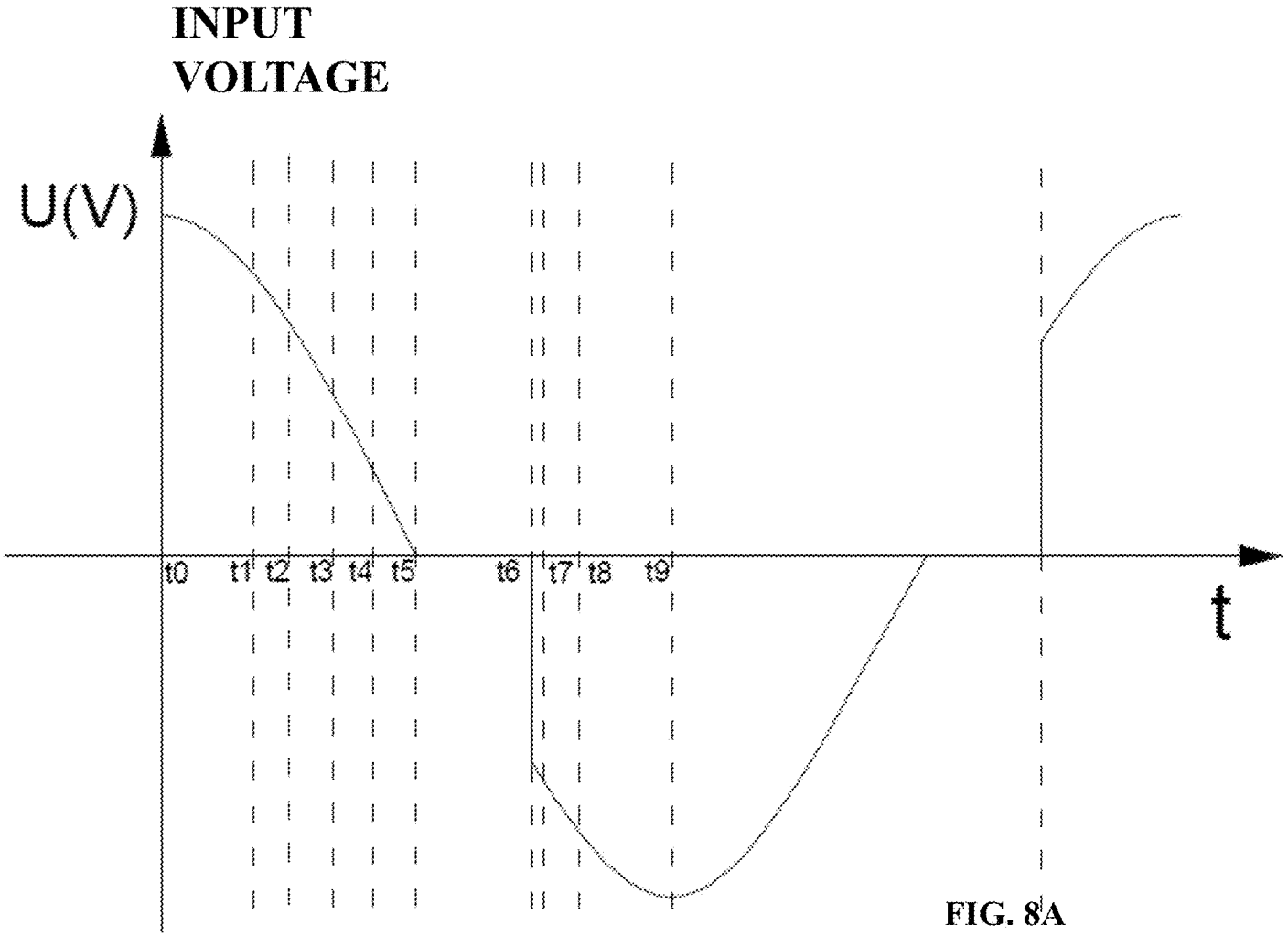
FIGS. 8A-8G depict schematic views of operational parameters associated with a dimming-down-to-80% operation mode of the lamp-control circuit of FIG. 1A.

Referring to the embodiment as depicted in FIG. 8A, the input voltage, U(V), is depicted for the 80-percent dimming operation mode. The input voltage is applied (received) across the power terminals 102. The x-axis represents time, and the y-axis represents the input voltage. The input voltage is depicted as a waveform. For instance, the input voltage includes (forms) a part of cosine function due to the phase cutting by the dimmer module 900 (the embodiment of which is depicted in FIG. 1B). For the 80-percent dimming operation mode, dimming of the light output of the LED array 128 reaches 80percent of the light output to be emitted by the LED array 128 for the non-dimming operation mode.

Figure 8B:
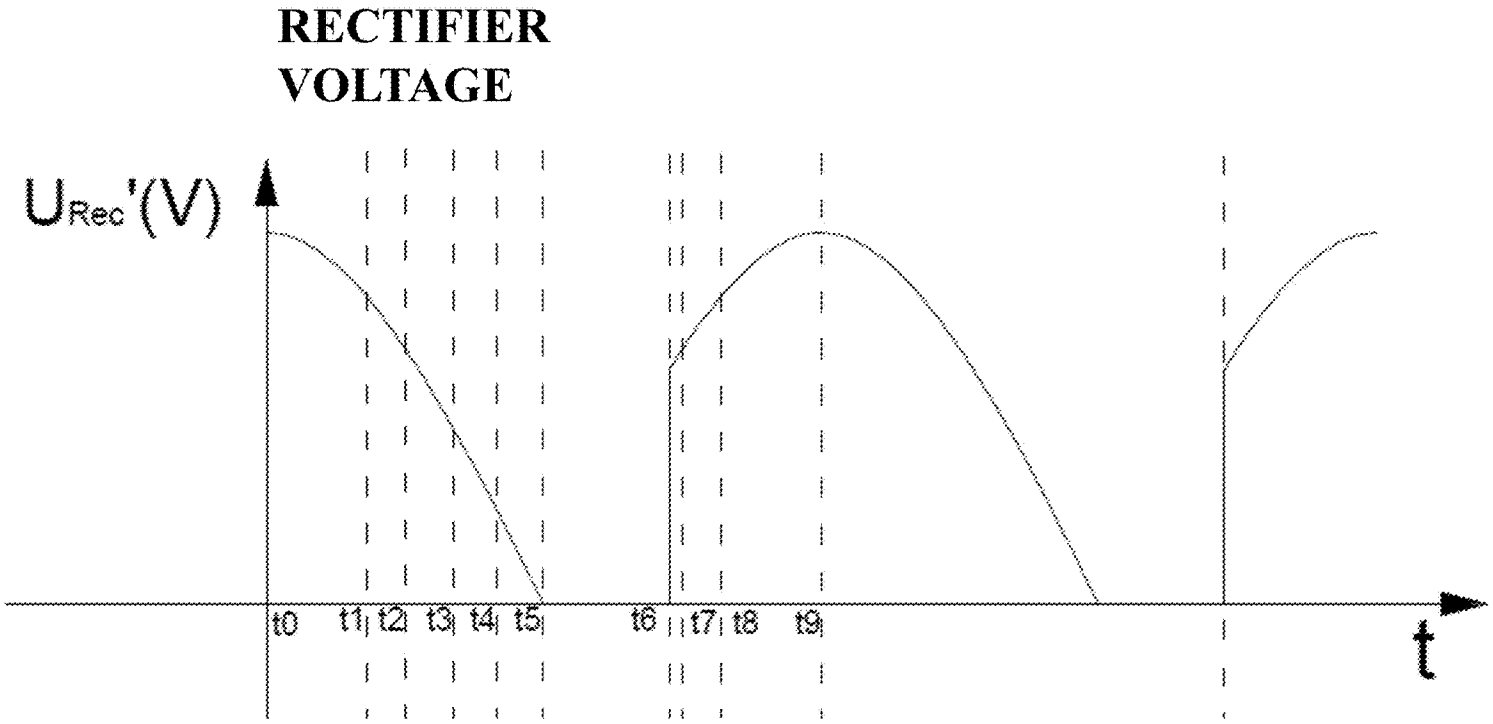

Referring to the embodiment as depicted in FIG. 8B, the rectifier output voltage, UREC'(V), is depicted for the 80-percent dimming operation mode. The rectifier output voltage (or rectifier voltage) is applied (received) across the output terminals of the rectifier bridge 108. The x-axis represents time, and the y-axis represents the rectifier output voltage. The rectifier output voltage is depicted as a waveform.

Figure 8C:
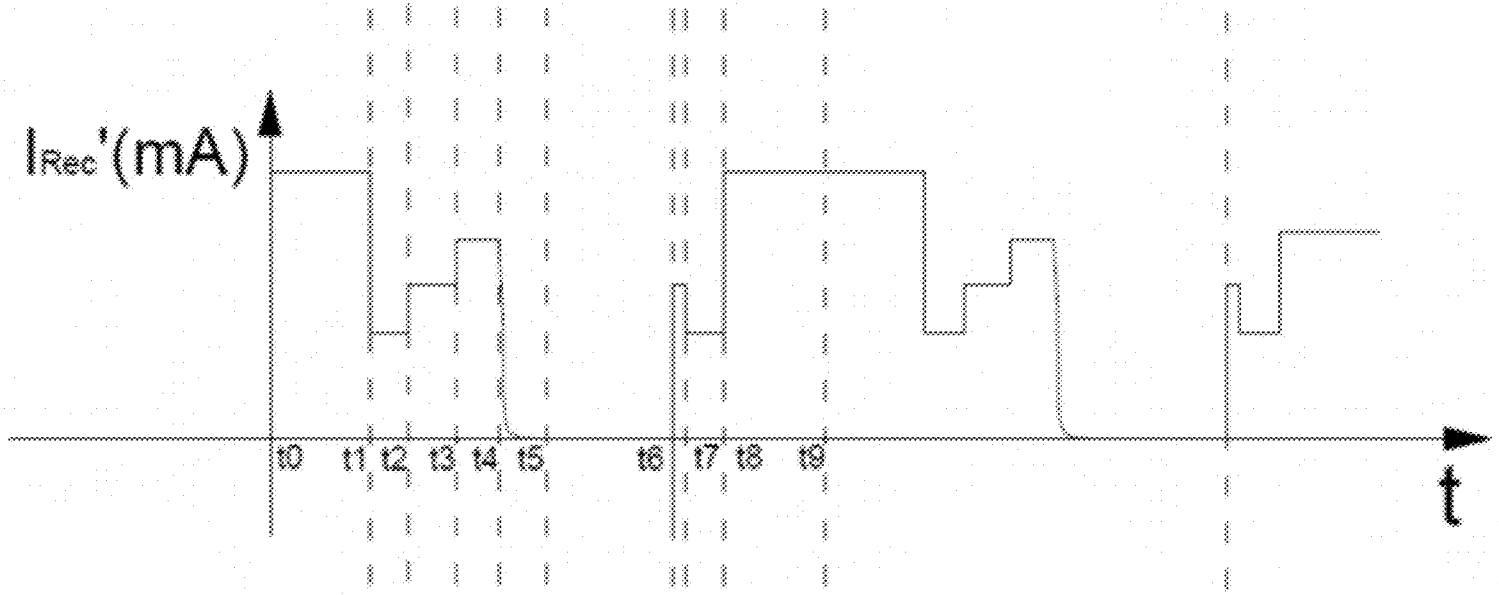

Referring to the embodiment as depicted in FIG. 8C, the rectifier output current, IREC'(mA), is depicted for the 80-percent dimming operation mode. The rectifier output current (or rectifier current) flows from (through) the output terminals of the rectifier bridge 108. The x-axis represents time, and the y-axis represents the rectifier output current. The rectifier output current is represented by a waveform. It will be appreciated that the rectifier output current equals the capacitor current plus the LED current.

Figure 8D:
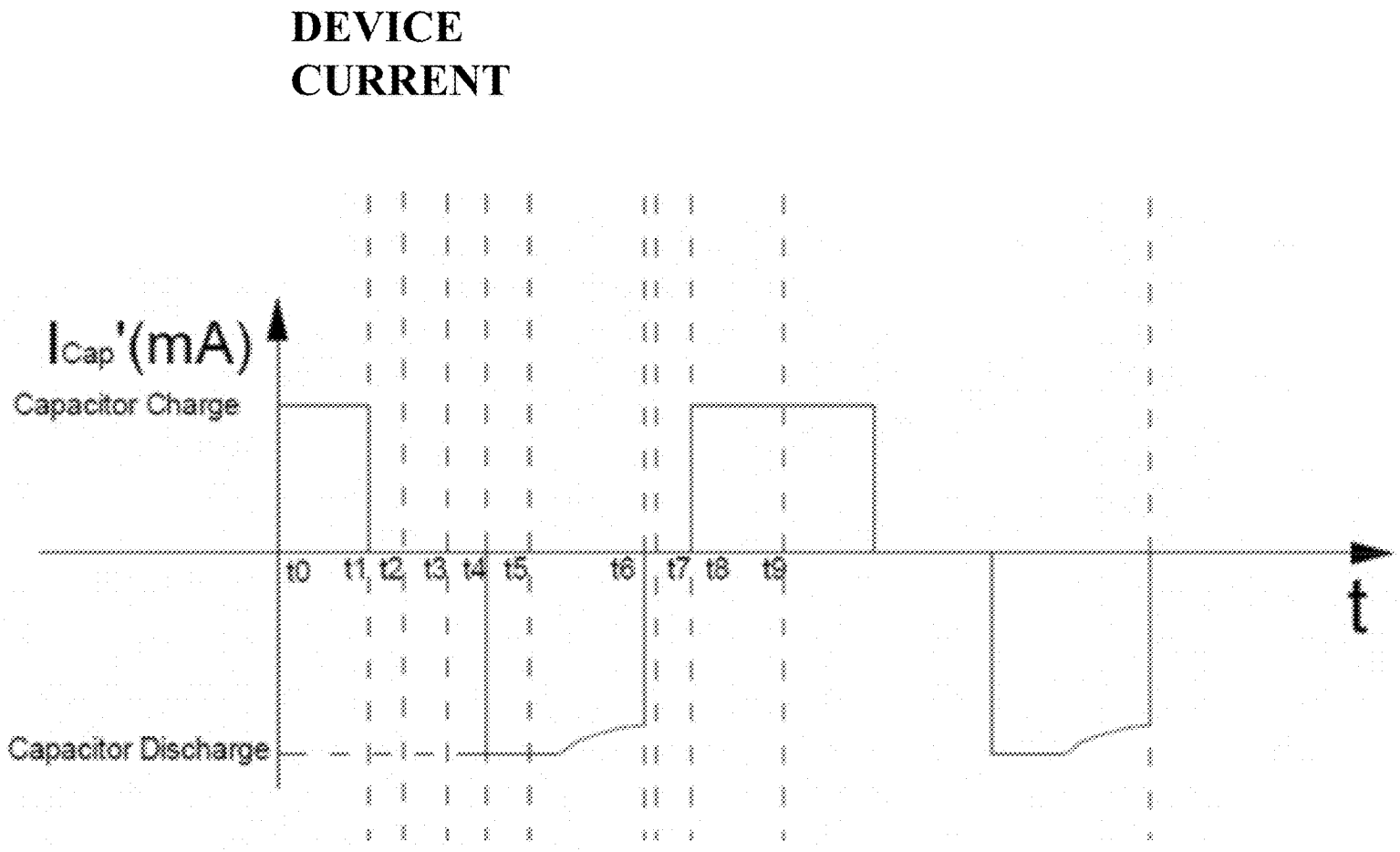

Referring to the embodiment as depicted in FIG. 8D, the capacitor current, ICAP'(mA), is depicted for the 80-percent dimming operation mode. The capacitor current, in use, flows through the energy-storage device 112. The energy-storage device 112 is either charged or is charging. The energy-storage device 112 is either discharged or is discharging. The x-axis represents time, and the y-axis represents the capacitor current. The capacitor current is represented by a waveform.

For the case where the rectifier output voltage is greater than or equal to (≥) the LED voltage (LED_4), the following conditions are true: (A) the capacitor current is positive, (B) the first main controllable switch 114 is ON, (C) the second main controllable switch 116 is OFF, and (D) the rectifier output voltage is utilized to charge the energy-storage device 112.

For the case where the rectifier output voltage is less than (<) the LED voltage (LED_1), the following conditions are true: (A) the capacitor current is negative, (B) the first main controllable switch 114 is OFF, (C) the second main controllable switch 116 is ON, (D) the energy-storage device 112 is discharging current to the first LED segment 130, and (E) the capacitor current equals (=) the negative value of the LED current (LED_1).

Figure 8E:
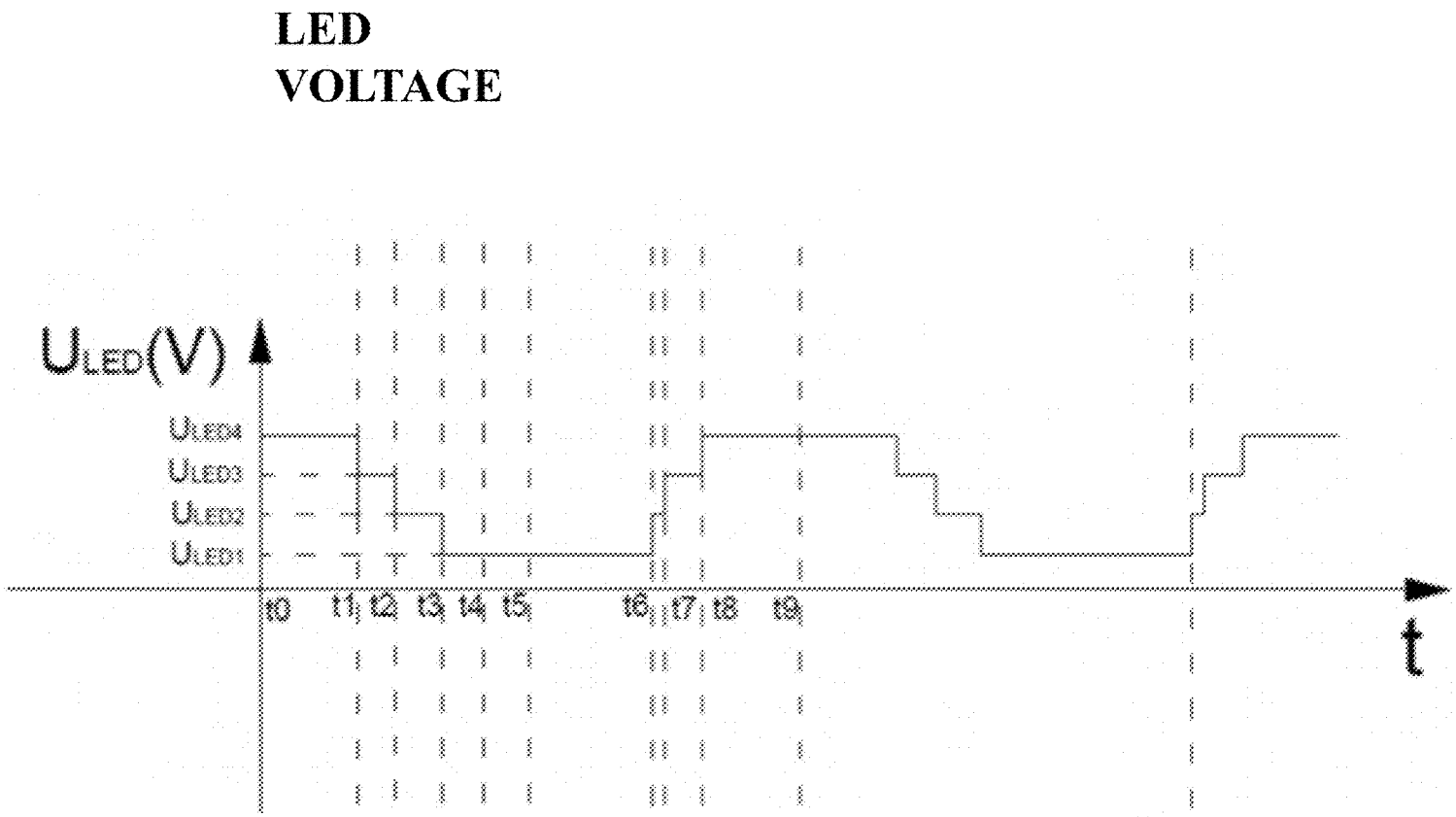

Referring to the embodiment as depicted in FIG. 8E, the LED voltage, ULED (V), is depicted for the 80-percent dimming operation mode. The LED voltage is the voltage across the LED array 128. The x-axis represents time, and the y-axis represents the LED voltage. The LED voltage is changed from LED voltage (LED_1) to LED voltage (LED_4) according to the value (magnitude) of the rectifier output voltage. The magnitude of the rectifier output voltage is measured or determined by the control logic unit 120.

The LED voltage (LED_1) is the voltage of the first LED segment 130. The LED voltage (LED_2) is the voltage sum of the first LED segment 130 and the second LED segment 140. The LED voltage (LED_3) is the voltage sum of the first LED segment 130, the second LED segment 140 and the third LED segment 150. The LED voltage (LED_4) is the voltage sum of the first LED segment 130, the second LED segment 140, the third LED segment 150 and the fourth LED segment 160.

Figure 8F:
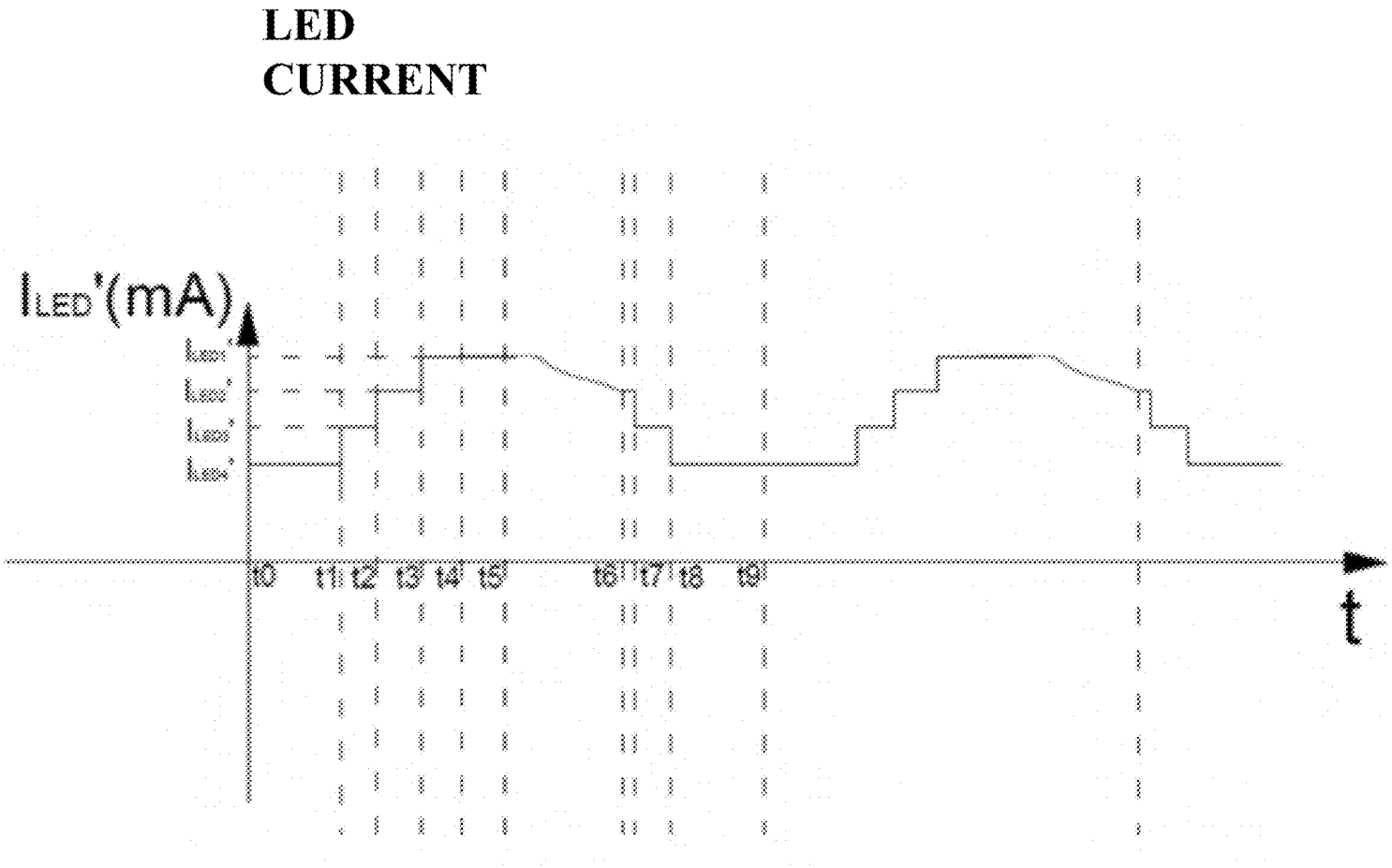

Referring to the embodiment as depicted in FIG. 8F, the LED current, ILED'(mA), is depicted for the 80-percent dimming operation mode. The LED current flows through the LED array 128. The x-axis represents time, and the y-axis represents the LED current. The LED current is self-adaptive according to the value of the rectifier output voltage. The LED current (LED_1) flows through the first LED segment 130. The LED current (LED_2) flows through the second LED segment 140. The LED current (LED_3) flows through the third LED segment 150. The LED current (LED_4) flows through the third LED segment 150.

For the case where the rectifier output voltage is greater than or equal to (≥) the LED voltage (LED_4), the following conditions are true: (A) the first controllable switch 132 is OFF, (B) the second controllable switch 142 is OFF, (C) the third controllable switch 152 is OFF, (D) the fourth controllable switch 162 is ON, and (E) the LED current equals (=) the LED current (LED_4).

For the case where the LED voltage (LED_4) is greater than (>) the rectifier output voltage, and the rectifier output voltage is greater than or equal to (≥) the LED voltage (LED_3), the following conditions are true: (A) the first controllable switch 132 is OFF, (B) the second controllable switch 142 is OFF, (C) the third controllable switch 152 is ON, (D) the fourth controllable switch 162 is OFF, and (E) the LED current equals (=) the LED current (LED_3).

For the case where the LED voltage (LED_3) is greater than or equal to (>) the rectifier output voltage, and the rectifier output voltage is greater than or equal to (≥) the LED voltage (LED_2), the following conditions are true: (A) the first controllable switch 132 is OFF, (B) the second controllable switch 142 is ON, (C) the third controllable switch 152 is OFF, (D) the fourth controllable switch 162 is OFF, and (E) the LED current equals (=) the LED current (LED_2).

For the case where the LED voltage (LED_2) is greater than (>) the rectifier output voltage, and the rectifier output voltage is greater than or equal to (≥) the LED voltage (LED_1), the following conditions are true: (A) the first controllable switch 132 is ON, (B) the second controllable switch 142 is OFF, (C) the third controllable switch 152 is OFF, (D) the fourth controllable switch 162 is OFF, and (E) the LED current equals (=) the LED current (LED_1).

For the case where the rectifier output voltage is less than (<) the LED voltage (LED_1), the following conditions are true: (A) the energy-storage device 112 is discharging the capacitor current to the first LED segment 130, (B) the first controllable switch 132 is ON, (C) the second controllable switch 142 is OFF, (D) the third controllable switch 152 is OFF, (E) the fourth controllable switch 162 is OFF, and (F) the LED current equals (=) the LED current (LED_1).

Figure 8G:
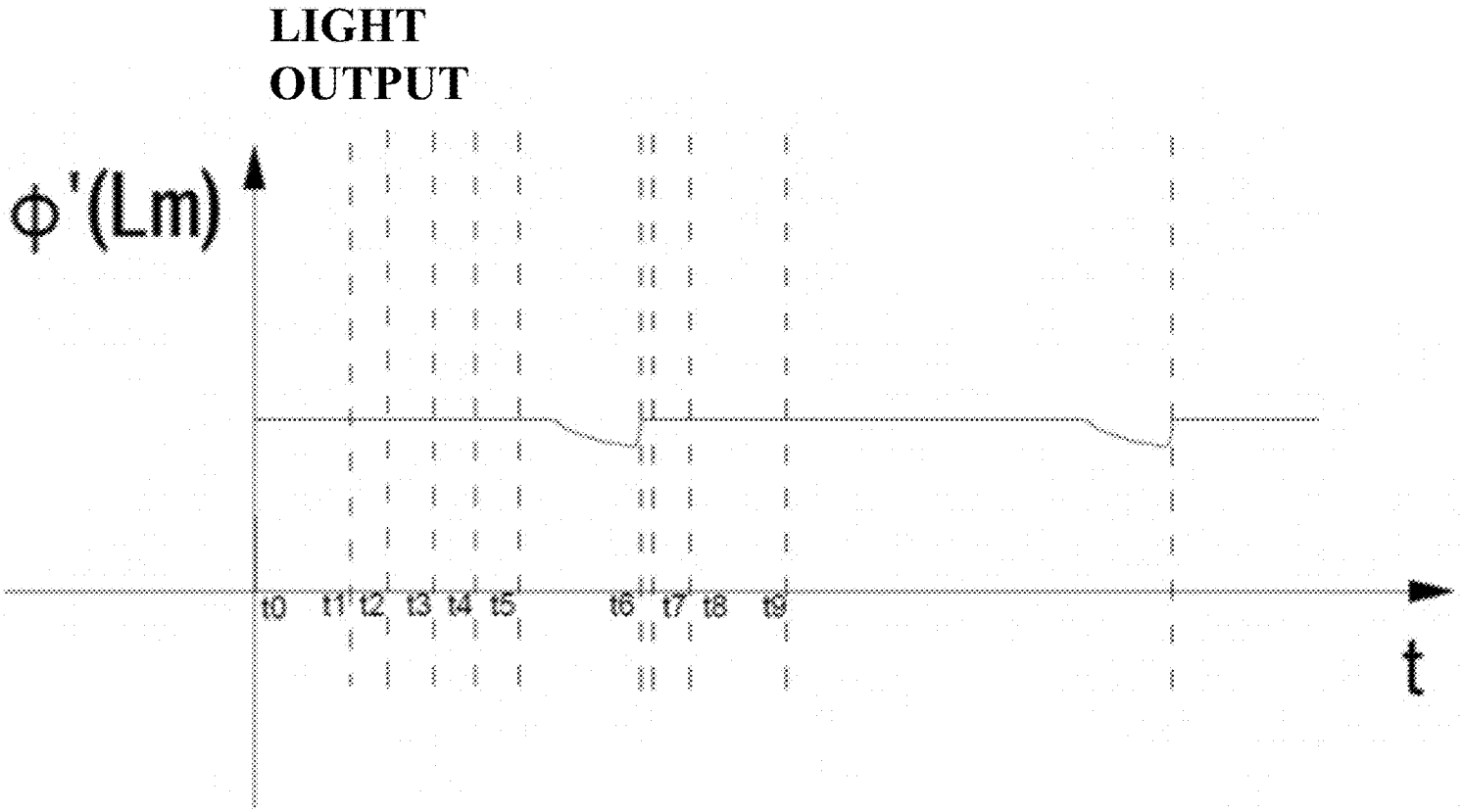

Referring to the embodiment as depicted in FIG. 8G, the light output is depicted for the 80-percent dimming operation mode. The x-axis represents time, and the y-axis represents the light output.

Sequence Analysis from Time (t0) to Time (t9) for 80-percent Dimming Operation Mode Operation Mode (A) Exists from Time (t0) to Time (t1).

From time (t0) to time (t1), the following conditions are true: (A) the rectifier output voltage is greater than or equal to (≥) the LED voltage (LED_4), (B) the first main controllable switch 114 is ON, (C) the second main controllable switch 116 is OFF, (D) the rectifier output voltage is utilized for charging the energy-storage device 112, and powering the LED array 128, (E) the first controllable switch 132 is ON, (F) the second controllable switch 142 is OFF, (G) the third controllable switch 152 is OFF, and (H) the fourth controllable switch 162 is OFF.

From time (t0) to time (t1), the following conditions exist: (A) the LED voltage equals (=) the LED voltage (LED_4), (B) the LED current equals (=) the LED current (LED_4), and (C) the rectifier output current equals (=) the LED current (LED_4) plus the capacitor current.

Operation Mode (B) Exists from Time (t1) to Time (t2).

From time (t1) to time (t2), the following conditions are true: (A) the LED voltage (LED_4) is greater than (>) the rectifier output voltage, and the rectifier output voltage is greater than or equal to (≥) the LED voltage (LED_3), (B) the first main controllable switch 114 is OFF, (C) the second main controllable switch 116 is OFF, (D) the energy-storage device 112 is open circuit, (E) the rectifier output voltage is used apply power to the LED array 128, (F) the first controllable switch 132 is OFF, (G) the second controllable switch 142 is OFF, (H) the third controllable switch 152 is ON, and (I) the fourth controllable switch 162 is OFF.

From time (t1) to time (t2), the following conditions exist: (A) the LED voltage equals (=) the LED voltage (LED_3), (B) the LED current equals (=) the LED current (LED_3), and (C) the rectifier output current equals (=) the LED current (LED_3).

Operation Mode (C) Exists from Time (t2) to Time (t3).

From time (t2) to time (t3), the following conditions are true: (A) the LED voltage (LED_3) is greater than (>) the rectifier output voltage, and the rectifier output voltage is greater than or equal to (≥) the LED voltage (LED_2), (B) the first main controllable switch 114 is OFF, (C) the second main controllable switch 116 is OFF, (D) the energy-storage device 112 is open circuit, (E) the rectifier output voltage is applied to power the LED array 128, (F) the first controllable switch 132 is OFF, (G) the second controllable switch 142 is ON, (H) the third controllable switch 152 is OFF, and (I) the fourth controllable switch 162 is OFF.

From time (t2) to time (t3), the following conditions exist: (A) the LED voltage equals (=) the LED voltage (LED_2), (B) the LED current equals (=) the LED current (LED_2), and (C) the rectifier output current equals (=) the LED current (LED_2).

Operation Mode (D) Exists from Time (t3) to Time (t4).

From time (t3) to time (t4), the following conditions are true: (A) the LED voltage (LED_2) is greater than (>) the rectifier output voltage, and the rectifier output voltage is greater than or equal to (≥) the LED voltage (LED_1), (B) the first main controllable switch 114 is OFF, (C) the second main controllable switch 116 is OFF, (D) the energy-storage device 112 is open circuit, (E) the rectifier output voltage is applied to power the LED array 128, (F) the first controllable switch 132 is ON, (G) the second controllable switch 142 is OFF, (H) the third controllable switch 152 is OFF, and (I) the fourth controllable switch 162 is OFF.

From time (t3) to time (t4), the following conditions exist: (A) the LED voltage equals (=) the LED voltage (LED_1), (B) the LED current equals (=) the LED current (LED_1), and (C) the rectifier output current equals (=) the LED current (LED_1).

Operation Mode (E) Exists from Time (t4) to Time (t6).

From time (t4) to time (t6), the following conditions are true: (A) the rectifier output voltage is less than (<) the LED voltage (LED_1), (B) the first main controllable switch 114 is OFF, (C) the second main controllable switch 116 is ON, (D) the energy-storage device 112 is discharging to LED array 128, (E) the first controllable switch 132 is ON, (F) the second controllable switch 142 is OFF, (G) the third controllable switch 152 is OFF, and (H) the fourth controllable switch 162 is OFF.

From time (t4) to time (t6) the following conditions exist: (A) the capacitor current equals (=) the negative value of the LED current (LED_1), (B) the LED voltage equals (=) the LED voltage (LED_1), (C) the LED current equals (=) the LED current (LED_1), and (D) the rectifier output current equals (=) capacitor current plus LED current equals (=) 0 (zero).

Operation Mode (F) Exists from Time (t6) to Time (t7).

From time (t6) to time (t7), the following conditions are true: (A) the LED voltage (LED_3) is greater than (>) the rectifier output voltage, and the rectifier output voltage is greater than or equal to (≥) the LED voltage (LED_2), (B) the first main controllable switch 114 is OFF, (C) the second main controllable switch 116 is OFF, (D) the energy-storage device 112 is open circuit, (E) the rectifier output voltage is applied to power the LED array 128, (F) the first controllable switch 132 is OFF, (G) the second controllable switch 142 is ON, (H) the third controllable switch 152 is OFF, and (I) the fourth controllable switch 162 is OFF.

From time (t6) to time (t7), the following conditions exist: (A) the LED voltage equals (=) the LED voltage (LED_2), (B) the LED current equals (=) the LED current (LED_2), and (C) the rectifier output current equals (=) the LED current (LED_2).

Operation Mode (G) Exists from Time (t7) to Time (t8).

From time (t7) to time (t8), the following conditions are true: (A) the LED voltage (LED_4) is greater than (>) the rectifier output voltage, and the rectifier output voltage is greater than or equal to (≥) the LED voltage (LED_3), (B) the first main controllable switch 114 is OFF, (C) the second main controllable switch 116 is OFF, (D) the energy-storage device 112 is open circuit, (E) the rectifier output voltage is applied to power the LED array 128, (F) the first controllable switch 132 is OFF, (G) the second controllable switch 142 is OFF, (H) the third controllable switch 152 is ON, and (I) the fourth controllable switch 162 is OFF.

From time (t7) to time (t8), the following conditions exist: (A) the LED voltage equals (=) the LED voltage (LED_3), (B) the LED current equals (=) the LED current (LED_3), and (C) the rectifier output current equals (=) the LED current (LED_3).

Operation Mode (H) Exists from Time (t8) to Time (t9).

From time (t8) to time (t9), the following conditions are true: (A) the rectifier output voltage is greater than or equal to (≥) the LED voltage (LED_4), (B) the first main controllable switch 114 is ON, (C) the second main controllable switch 116 is OFF, (D) the rectifier output voltage is charging the energy-storage device 112, and is applied to the LED array 128, (E) the first controllable switch 132 is OFF, (F) the second controllable switch 142 is OFF, (G) the third controllable switch 152 is OFF, and (H) the fourth controllable switch 162 is ON.

From time (t8) to time (t9), the following conditions exist: (A) the LED voltage equals (=) the LED voltage (LED_4), (B) the LED current equals (=) the LED current (LED_4), and (C) the rectifier output current equals (=) the LED current (LED_4) plus the capacitor current.

20 Percent Dimming Operation Mode

FIGS. 9A-9G depict schematic views of operational parameters associated with a dimming-down-to-20% operation mode of the lamp-control circuit 100 as depicted in FIG. 1A.

Figure 9A:
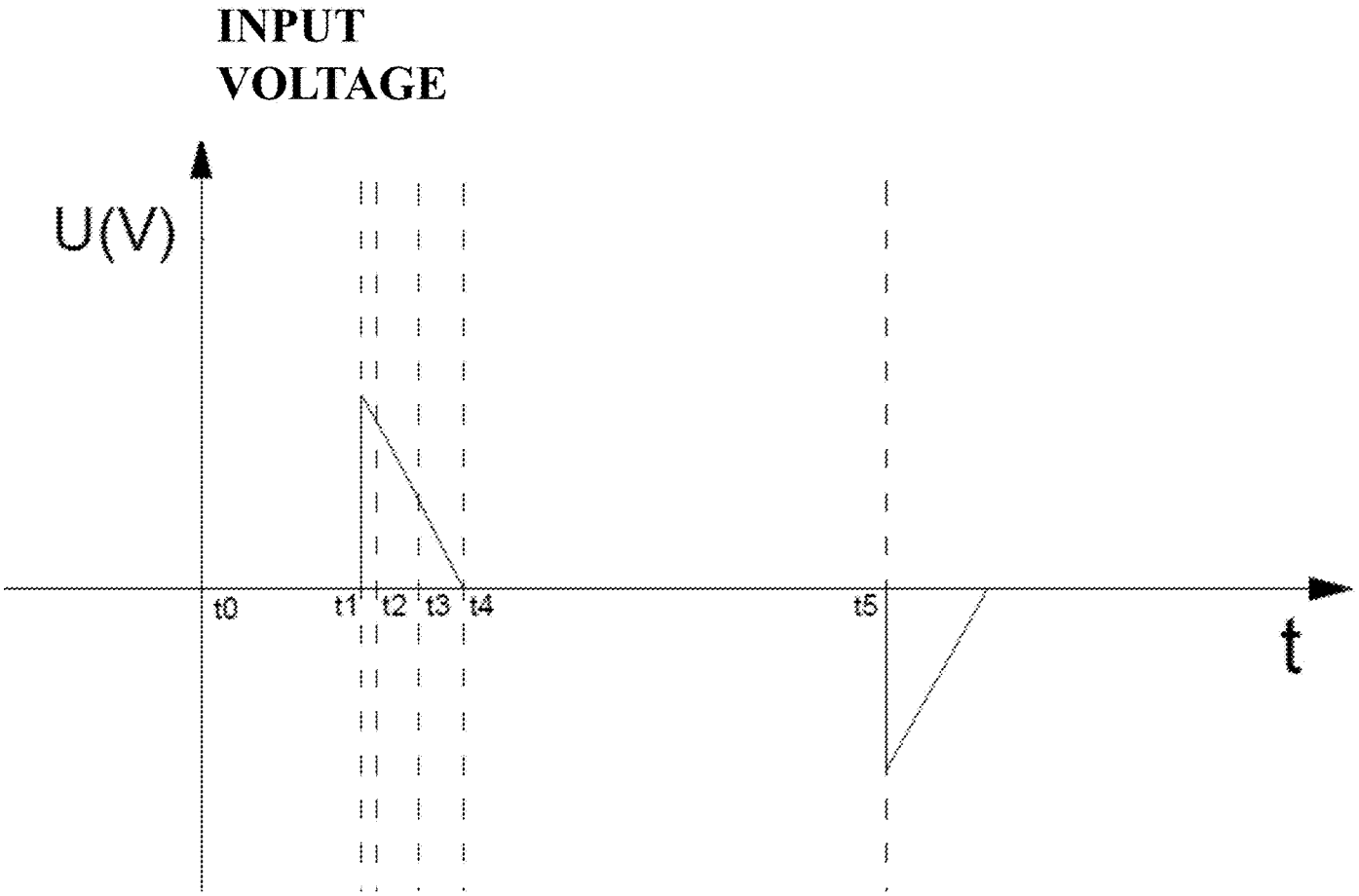
FIGS. 9A-9G depict schematic views of operational parameters associated with a dimming-down-to-20% operation mode of the lamp-control circuit of FIG. 1A.

FIG. 9A depicts an embodiment of the input voltage (for the 20-percent dimming operation mode) along the y-axis. The waveform of input voltage is depicted as a cosine function due to the phase cutting by the dimmer module 900 (such as a TRIAC dimmer) under the dimming down to 20 percent operation mode. For the 20-percent dimming operation mode, dimming of the light output of the LED array 128 reaches 20 percent of the light output to be emitted by the LED array 128 for the non-dimming operation mode.

Figure 9B:
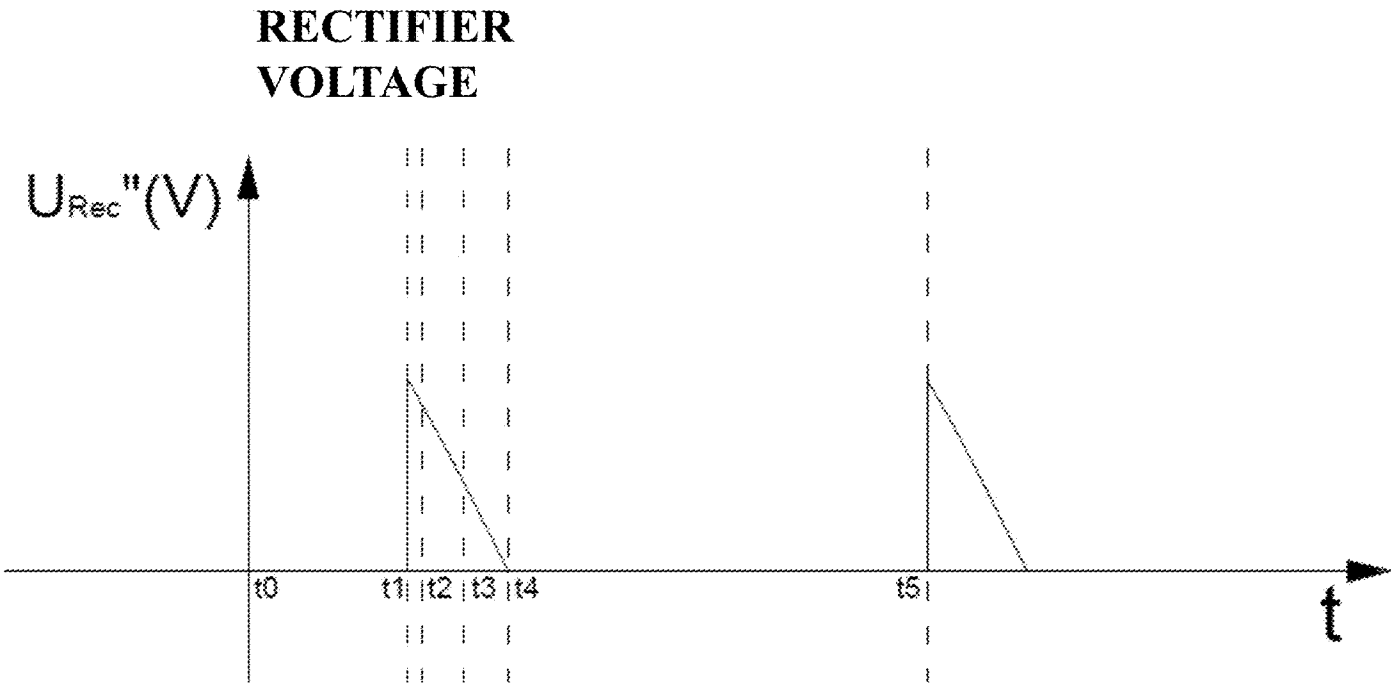

FIG. 9B depicts an embodiment of the rectifier output voltage (for the 20-percent dimming operation mode) along the y-axis. The waveform of the rectifier output voltage of the rectifier bridge 108 is depicted under the dimming down to 20 percent operation mode.

Figure 9C:
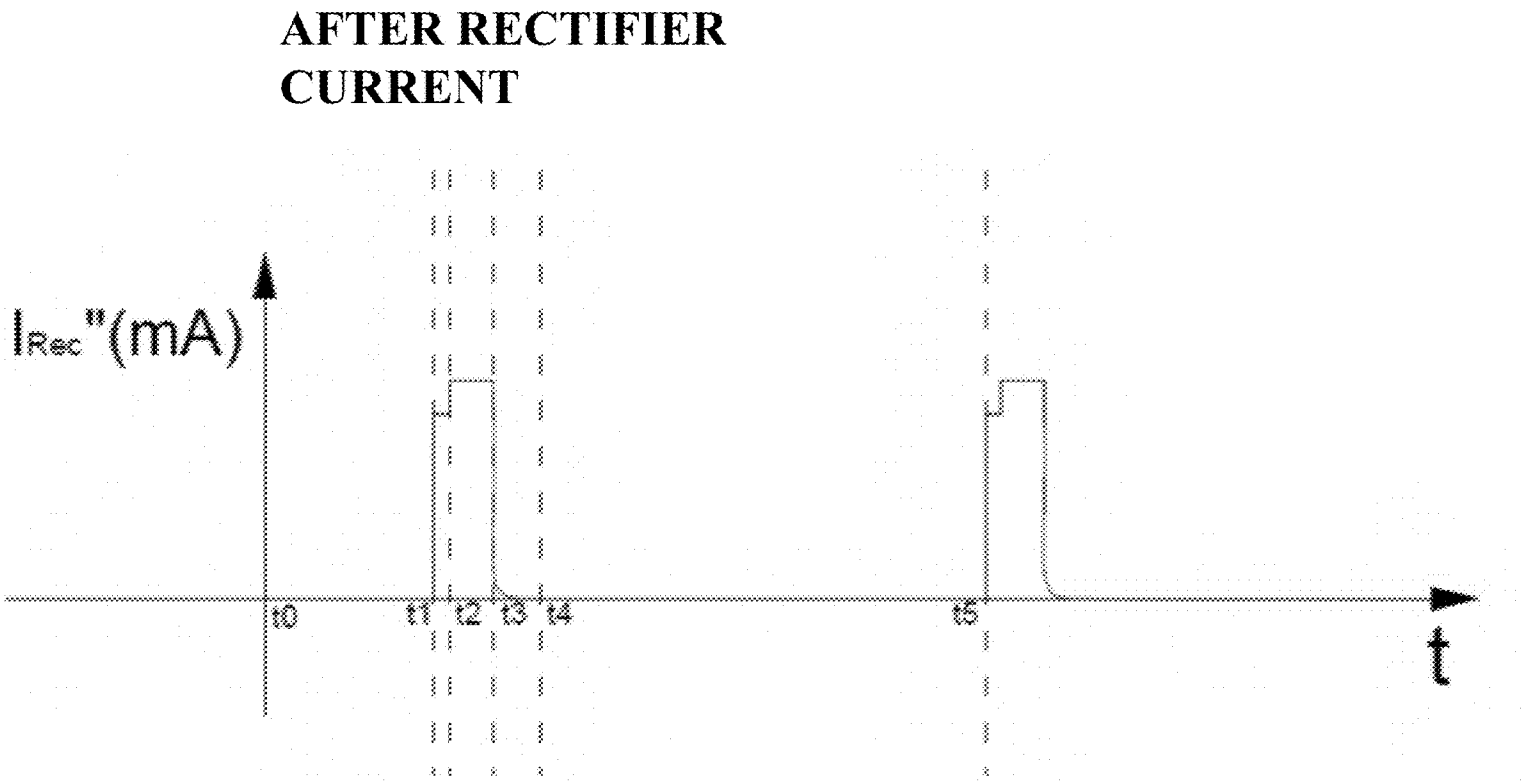

FIG. 9C depicts an embodiment of the rectifier output current (for the 20-percent dimming operation mode) along the y-axis. The waveform of recitfier output current of the rectifier bridge 108 is depicted (under the dimming down to 20 percent operation mode). The rectifier output current equals (=) the capacitor current plus the LED current.

Figure 9D:
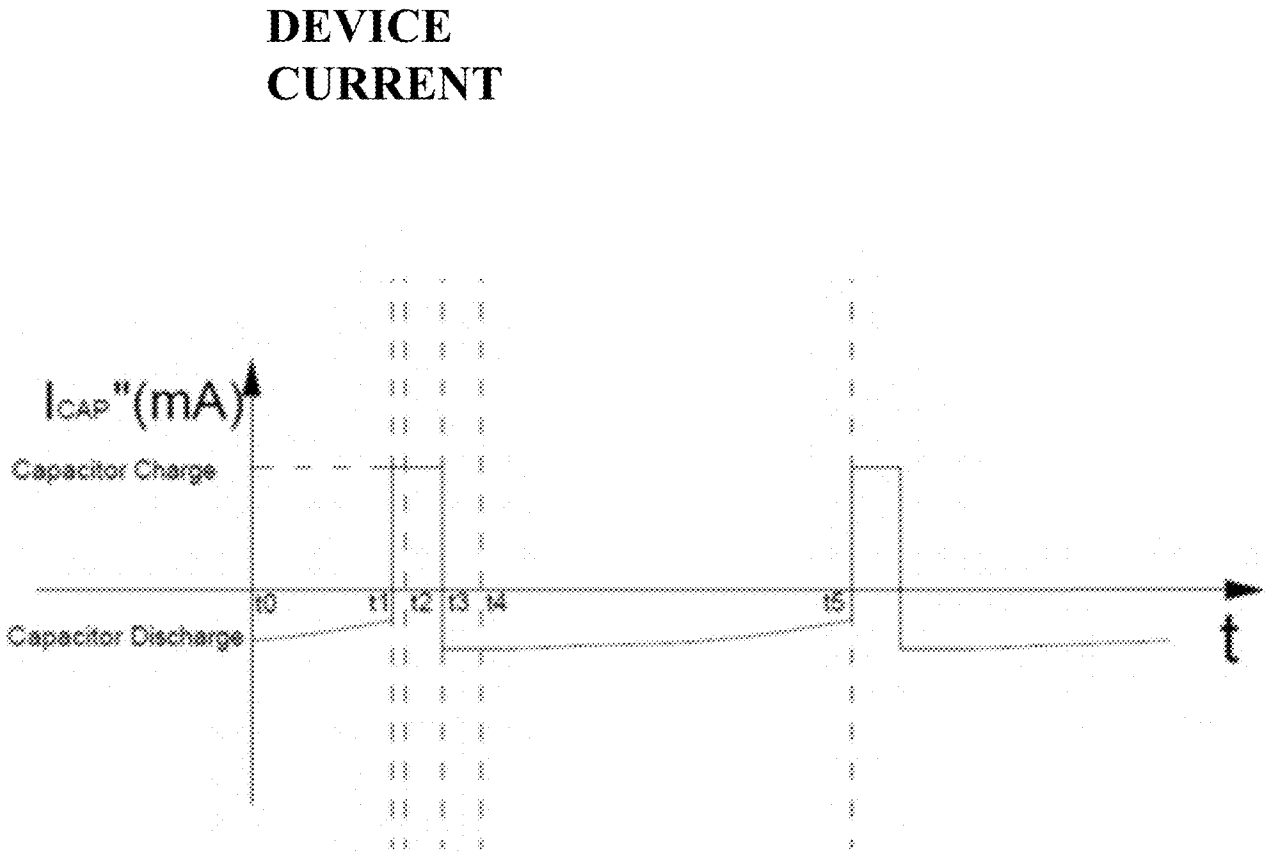

FIG. 9D depicts an embodiment of the capacitor current (for the 20-percent dimming operation mode) along the y-axis. The waveform of current on the energy-storage device 112 is depicted (under the dimming down to 20 percent operation mode).

For the case where the rectifier output voltage is greater than or equal to (≥) the LED voltage (LED_4), the following conditions are true: (A) the capacitor current is defined as positive, (B) the first main controllable switch 114 is ON, (C) the second main controllable switch 116 is OFF, and (D) the rectifier output voltage is utilized for charging to the energy-storage device 112.

For the case where the rectifier output voltage is less than (<) the LED voltage (LED_1), the following conditions are true: (A) the capacitor current is defined as negative, (B) the first main controllable switch 114 is OFF, (C) the second main controllable switch 116 is ON, (D) the energy-storage device 112 is discharging the capacitor current to the first LED segment 130, and (E) the capacitor current equals (=) the negative value of the LED current (LED_1).

Figure 9E:
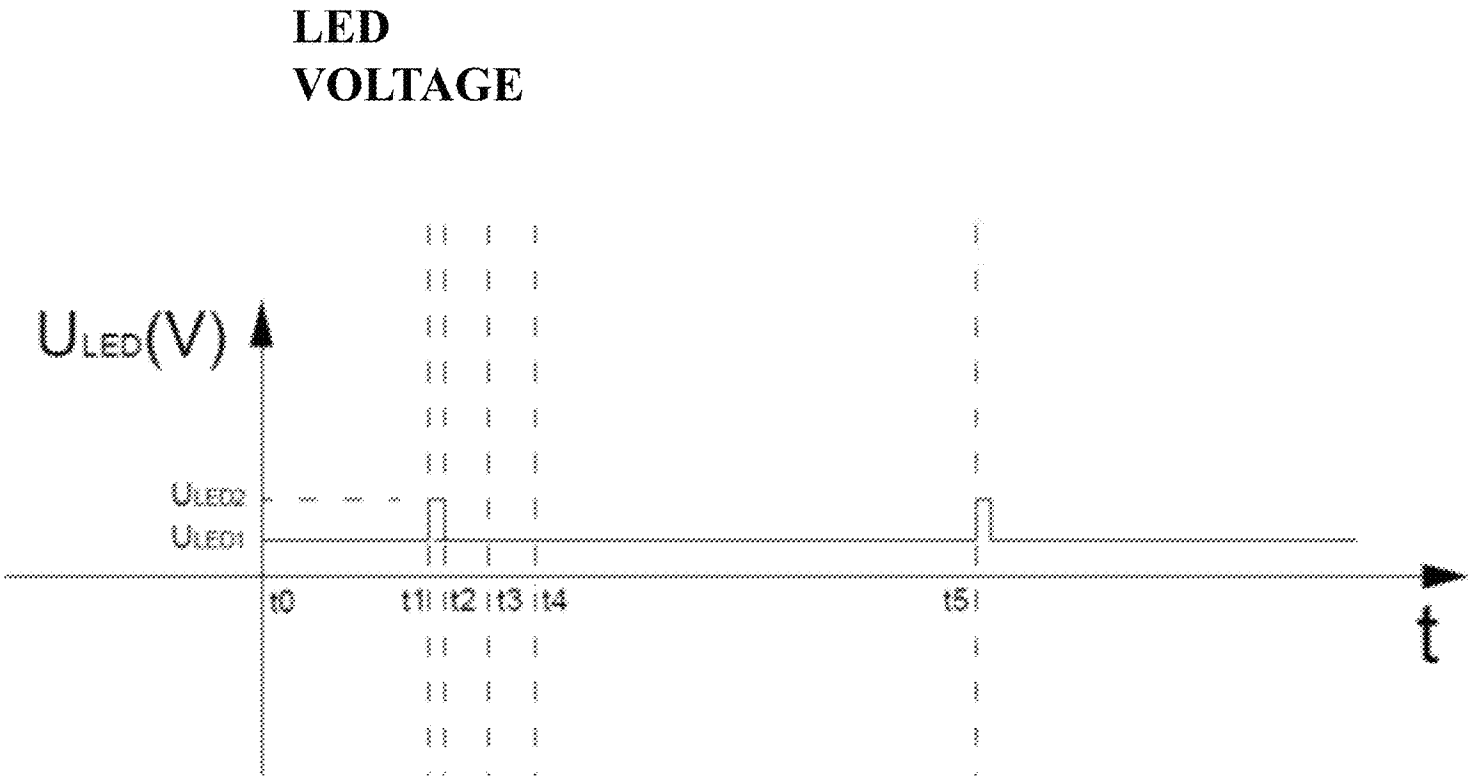

FIG. 9E depicts an embodiment of the LED voltage (for the 20-percent dimming operation mode) along the y-axis. The waveform of voltage on (across) the LED array 128 is depicted (under the dimming down to 20 percent operation mode). The LED voltage is changed from the LED voltage (LED_1) to the LED voltage (LED_4) according to the rectifier output voltage.

For the case where the dimming down to 20-percent mode is operational, the following conditions are true: (A) the rectifier output voltage is always less than the LED voltage (LED_3) so that the third LED segment 150 and the fourth LED segment 160 are open circuit, (B) the LED voltage (LED_2) is the voltage sum of the first LED segment 130 and the second LED segment 140, and (C) the LED voltage (LED_1) is the voltage of the first LED segment 130.

Figure 9F:
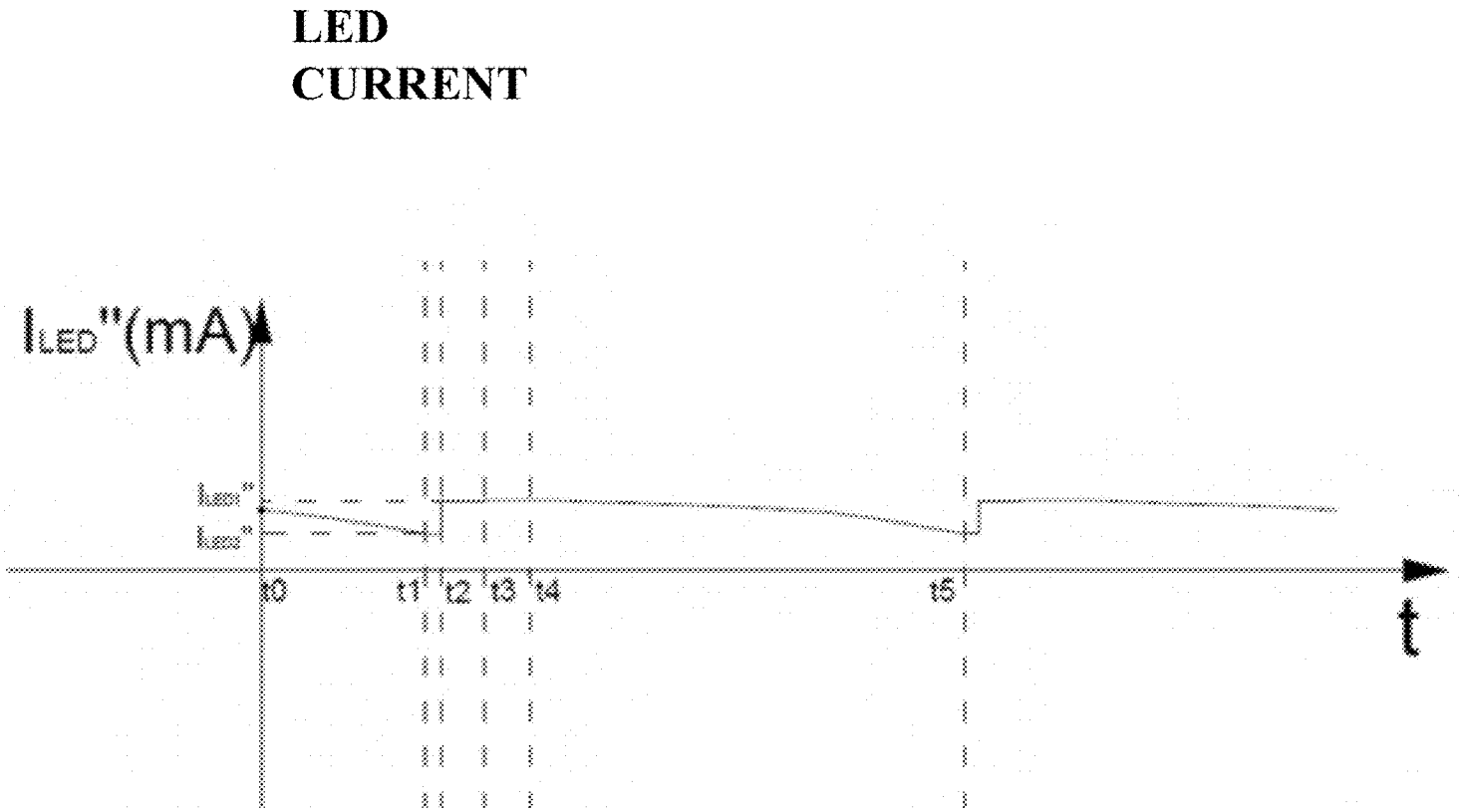

FIG. 9F depicts an embodiment of the LED current (for the 20-percent dimming operation mode) along the y-axis. The waveform of the current flowing through the LED array 128 is depicted (under the dimming down to 20 percent operation mode). The LED current is self-adaptive according to the rectifier output voltage.

For the case where the LED voltage (LED_3) is greater than (>) the rectifier output voltage, and the rectifier output voltage is greater than or equal to (≥) the LED voltage (LED_2), the following conditions are true: (A) the first controllable switch 132 is OFF, (B) the second controllable switch 142 is ON, (C) the third controllable switch 152 is OFF, (D) the fourth controllable switch 162 is OFF, and (E) the LED current equals (=) the LED current (LED_2).

For the case where the LED voltage (LED_2) is greater than (>) the rectifier output voltage, and the rectifier output voltage is greater than or equal to (≥) the LED voltage (LED_1), the following conditions are true: (A) the first controllable switch 132 is ON, (B) the second controllable switch 142 is OFF, (C) the third controllable switch 152 is OFF, (D) the fourth controllable switch 162 is OFF, and (E) the LED current equals (=) the LED current (LED_1).

For the case where the rectifier output voltage is less than (<) the LED voltage (LED_1), the following conditions are true: (A) the energy-storage device 112 is discharging to the first LED segment 130, (B) the first controllable switch 132 is ON, (C) the second controllable switch 142 is OFF, (D) the third controllable switch 152 is OFF, (E) the fourth controllable switch 162 is OFF, and (F) the LED current equals (=) the LED current (LED_1).

Figure 9G:
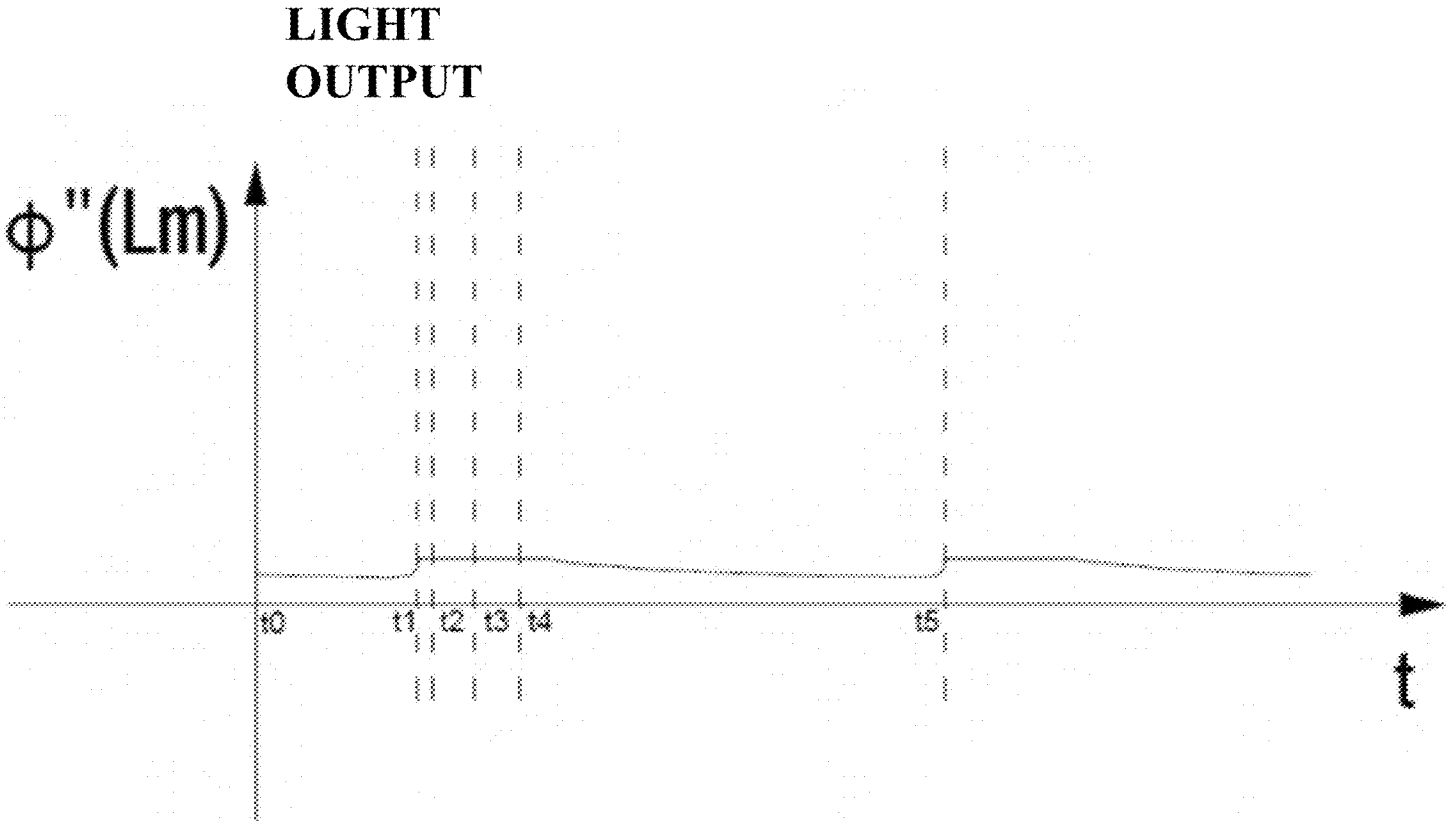

FIG. 9G depicts an embodiment of the light output (for the 20-percent dimming operation mode) along the y-axis, in which the waveform of light output on LED array under the dimming down to 20 percent operation mode.

Sequence Analysis from Time (t0) to Time (t5) for 20-percent Dimming Operation Mode Operation Mode (A) Exists from Time (t0) to Time (t1).

From time (t0) to time (t1), the following conditions are true: (A) the rectifier output voltage is less than (<) the LED voltage (LED_1), (B) the first main controllable switch 114 is OFF, (C) the second main controllable switch 116 is ON, (D) the energy-storage device 112 is discharging to LED array 128, (E) the first controllable switch 132 is ON, (F) the second controllable switch 142 is OFF, (G) the third controllable switch 152 is OFF, and (H) the fourth controllable switch 162 is OFF.

From time (t0) to time (t1), the following conditions exist: (A) the capacitor current equals (=) the negative value of the LED current (LED_1), (B) the LED voltage equals (=) the LED voltage (LED_1), (C) the LED current equals (=) the LED current (LED_1), and (D) the rectifier output current equals (=) the capacitor current plus the LED current equals (=) 0 (zero).

Operation Mode (B) Exists from Time (t1) to Time (t2).

From time (t1) to time (t2), the following conditions are true: (A) the LED voltage (LED_3) is greater than (>) the rectifier output voltage, and the rectifier output voltage is greater than or equal to (≥) the LED voltage (LED_2),(B) the first main controllable switch 114 is ON, (C) the second main controllable switch 116 is OFF, (D) the rectifier output voltage is utilized for charging to the energy-storage device 112, and is also utilized for powering the LED array 128, (E) the first controllable switch 132 is OFF, (F) the second controllable switch 142 is ON, (G) the third controllable switch 152 is OFF, and (H) the fourth controllable switch 162 is OFF.

From time (t1) to time (t2), the following conditions exist: (A) the LED voltage equals (=) the LED voltage (LED_2), (B) the LED current equals (=) the LED current (LED_2), and (C) the rectifier output current equals (=) the LED current (LED_2) plus the capacitor current.

Operation Mode (C) Exists from Time (t2) to Time (t3).

From time (t2) to time (t3), the following conditions are true: (A) the LED voltage (LED_2) is greater than (>) the rectifier output voltage, and the rectifier output voltage is greater than or equal to (≥) the LED voltage (LED_1), (B) the first main controllable switch 114 is ON, (C) the second main controllable switch 116 is OFF, (D) the rectifier output voltage is utilized for charging the energy-storage device 112, and for powering the LED array 128, (E) the first controllable switch 132 is ON, (F) the second controllable switch 142 is OFF, (G) the third controllable switch 152 is OFF, and (H) the fourth controllable switch 162 is OFF.

From time (t2) to time (t3), the following conditions exist: (A) the LED voltage equals (=) the LED voltage (LED_1), (B) the LED current equals (=) the LED current (LED_1), and (C) the rectifier output current equals (=) the LED current (LED_1) plus the capacitor current.

Operation Mode (D) Exists from Time (t3) to Time (t4).

From time (t3) to time (t4), the following conditions are true: (A) the rectifier output voltage is less than (<) the LED voltage (LED_1), (B) the first main controllable switch 114 is OFF, (C) the second main controllable switch 116 is ON, (D) the energy-storage device 112 is discharging to the LED array 128, (E) the first controllable switch 132 is ON, (F) the second controllable switch 142 is OFF, (G) the third controllable switch 152 is OFF, and (H) the fourth controllable switch 162 is OFF.

From time (t3) to time (t4), the following conditions exist: (A) the capacitor current equals (=) the negative value of the LED current (LED_1), (B) the LED voltage equals (=) the LED voltage (LED_1), (C) the LED current equals (=) the LED current (LED_1), and (D) the rectifier output current equals (=) the capacitor current plus the LED current equals (=) 0 (zero).

Operation Mode (E) Exists from Time (t4) to Time (t5).

From time (t4) to time (t5), the following conditions are true: (A) the rectifier output voltage is less than (<) the LED voltage (LED_1), (B) the first main controllable switch 114 is OFF, (C) the second main controllable switch 116 is ON, (D) the energy-storage device 112 is discharging to the LED array 128, (E) the first controllable switch 132 is ON, (F) the second controllable switch 142 is OFF, (G) the third controllable switch 152 is OFF, and (H) the fourth controllable switch 162 is OFF.

From time (t4) to time (t5), the following conditions exist: (A) the capacitor current equals (=) the negative value of the LED current (LED_1), (B) the LED voltage equals (=) the LED voltage (LED_1), (C) the LED current equals (=) the LED current (LED_1), and (D) the rectifier output current equals (=) the capacitor current plus the LED current equals (=) 0 (zero).

It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a lamp-control circuit configured to be electrically connectable to an electrical source having an output voltage that forms a periodic wave formation; and the lamp-control circuit also configured to be electrically connectable to a lamp array in such a way that electrical current, in use, flows from the electrical source to, and through, the lamp array, in which the lamp array includes lamp segments; and the lamp-control circuit also configured to urge each lamp segment of the lamp array to consume constant power for a portion of a cycle of the output voltage of the electrical source in such a way that said each lamp segment of the lamp array, in use, emits a constant light output for the portion the cycle of the output voltage of the electrical source; and wherein:

the lamp-control circuit includes:

an energy-storage device configured to be electrically connectable to the lamp array; and a control logic unit configured to be electrically connectable to the energy-storage device; and the control logic unit also configured to selectively urge charging, and selectively urge discharging, of the energy-storage device.

2. The apparatus of claim 1, wherein:

the control logic unit is also configured to urge charging of the energy-storage device with electrical energy provided by the electrical source once the control logic unit, in use, determines that the output voltage of the electrical source is higher than a first predetermined value associated with a selected lamp segment of the lamp array.

3. The apparatus of claim 1, wherein:

the control logic unit is also configured to urge discharging of electrical energy from the energy-storage device to a selected lamp segment of the lamp array once the control logic unit, in use, determines that the output voltage of the electrical source is lower than a second predetermined value associated with said selected lamp segment of the lamp array.

4. The apparatus of claim 1, wherein:

the control logic unit is configured to interact with a dimmer detection unit, in which the dimmer detection unit is configured to be electrically connectable to the lamp-control circuit; and the control logic unit and the dimmer detection unit are configured to make a determination of whether a dimmer module is electrically connected to the lamp-control circuit.

5. The apparatus of claim 1, wherein:

the control logic unit is configured to interact with a segment detection unit, in which the segment detection unit is configured to be electrically connectable to said each lamp segment of the lamp array in such a way that the control logic unit, in use, controls an amount of power consumed by said each lamp segment of the lamp array.

6. An apparatus, comprising:

a lamp-control circuit configured to be electrically connectable to an electrical source having an output voltage that forms a periodic wave formation; and the lamp-control circuit also configured to be electrically connectable to a light-emitting diode array in such a way that electrical current, in use, flows from the electrical source to, and through, the light-emitting diode array, in which the light-emitting diode array includes light-emitting diode segments; and the lamp-control circuit also configured to urge each light-emitting diode segment of the light-emitting diode array to consume constant power for a portion of a cycle of the output voltage of the electrical source in such a way that said each light-emitting diode segment of the light-emitting diode array, in use, emits a constant light output for the portion the cycle of the output voltage of the electrical source; and wherein:

the lamp-control circuit includes:

an energy-storage device configured to be electrically connectable to the light-emitting diode array; and a control logic unit configured to be electrically connectable to the energy-storage device; and the control logic unit also configured to selectively urge charging and selectively urge discharging of the energy-storage device.

7. The apparatus of claim 6, wherein:

the lamp-control circuit is also configured to urge said each light-emitting diode segment of the light-emitting diode array to:

consume said constant power for a duration of the cycle of the output voltage of the electrical source; and emit the constant light output for the duration of the cycle of the output voltage of the electrical source.

8. The apparatus of claim 6, wherein:

the lamp-control circuit is also configured to control the electrical current flowing through the light-emitting diode array according to an aspect of the periodic wave formation of the output voltage of the electrical source.

9. The apparatus of claim 6, wherein:

the control logic unit is also configured to urge charging of the energy-storage device with electrical energy provided by the electrical source once the control logic unit, in use, determines that the output voltage of the electrical source is higher than a first predetermined value associated with a light-emitting diode segment of the light-emitting diode array.

10. The apparatus of claim 6, wherein:

the control logic unit is also configured to urge discharging of electrical energy from the energy-storage device to a light-emitting diode segment of the light-emitting diode array once the control logic unit, in use, determines that the output voltage of the electrical source is lower than a second predetermined value associated with the light-emitting diode segment of the light-emitting diode array.

11. The apparatus of claim 6, wherein:

the control logic unit is also configured to urge current flowing through a light-emitting diode segment of the light-emitting diode array to have a maximum value for a case where the output voltage of the electrical source has a minimum value.

12. The apparatus of claim 6, wherein:

the control logic unit is also configured to urge current flowing through a light-emitting diode segment of the light-emitting diode array to have a reduced value for a case where the output voltage of the electrical source has an increased value.

13. The apparatus of claim 6, wherein:

the control logic unit is configured to interact with a dimmer detection unit, in which the dimmer detection unit is configured to be electrically connectable to the lamp-control circuit; and the control logic unit and the dimmer detection unit are configured to make a determination of whether a dimmer module is electrically connected to the lamp-control circuit.

14. The apparatus of claim 6, wherein:

the control logic unit is configured to interact with a segment detection unit, in which the segment detection unit is configured to be electrically connectable to said each light-emitting diode segment of the light-emitting diode array in such a way that the control logic unit, in use, controls an amount of power consumed by said each light-emitting diode segment of the light-emitting diode array.

15. The apparatus of claim 6, wherein:

the energy-storage device includes a capacitor configured to be electrically connectable to the light-emitting diode array.

16. The apparatus of claim 6, wherein:

the energy-storage device is configured to supply electrical power to the light-emitting diode array for a case where the output voltage of the electrical source is lower than a second predetermined value in such a way that the energy-storage device, in use, urges the light-emitting diode array to consume said constant power so that the light-emitting diode array, in use, emits said constant light output; and wherein:

a dimmer module is configured to be electrically connectable to the lamp-control circuit; and the lamp-control circuit is configured to urge the light-emitting diode array to consume said constant power in such a way that the light-emitting diode array, in use, emits said constant light output.

17. The apparatus of claim 6, wherein:

the energy-storage device is configured to supply electrical power to the light-emitting diode array for a case where the output voltage of the electrical source is lower than a second predetermined value in such a way that the energy-storage device, in use, urges the light-emitting diode array to consume said constant power so that the light-emitting diode array, in use, emits said constant light output.

18. The apparatus of claim 6, wherein:

a dimmer module is configured to be electrically connectable to the lamp-control circuit; and the lamp-control circuit is configured to urge the light-emitting diode array to consume said constant power in such a way that the light-emitting diode array, in use, emits said constant light output.

19. An apparatus, comprising:

a lamp-control circuit configured to be electrically connectable to an electrical source having an output voltage that forms a periodic wave formation; and the lamp-control circuit also configured to be electrically connectable to a light-emitting diode array in such a way that electrical current, in use, flows from the electrical source to, and through, the light-emitting diode array, in which the light-emitting diode array includes light-emitting diode segments; and the lamp-control circuit also configured to urge each light-emitting diode segment of the light-emitting diode array to consume constant power for a portion of a cycle of the output voltage of the electrical source in such a way that said each light-emitting diode segment of the light-emitting diode array, in use, emits a constant light output for the portion the cycle of the output voltage of the electrical source; and wherein:

the lamp-control circuit includes:

an energy-storage device configured to supply electrical power to the light-emitting diode array for a case where the output voltage of the electrical source is lower than a second predetermined value in such a way that the energy-storage device, in use, urges the light-emitting diode array to consume said constant power so that the light-emitting diode array, in use, emits said constant light output.

20. An apparatus, comprising:

a lamp-control circuit configured to be electrically connectable to an electrical source having an output voltage that forms a periodic wave formation; and the lamp-control circuit also configured to be electrically connectable to a light-emitting diode array in such a way that electrical current, in use, flows from the electrical source to, and through, the light-emitting diode array, in which the light-emitting diode array includes light-emitting diode segments; and the lamp-control circuit also configured to urge each light-emitting diode segment of the light-emitting diode array to consume constant power for a portion of a cycle of the output voltage of the electrical source in such a way that said each light-emitting diode segment of the light-emitting diode array, in use, emits a constant light output for the portion the cycle of the output voltage of the electrical source; and wherein:

a dimmer module is configured to be electrically connectable to the lamp-control circuit; and the lamp-control circuit is configured to urge the light-emitting diode array to consume said constant power in such a way that the light-emitting diode array, in use, emits said constant light output.

* * * * *